US008899306B2

(12) United States Patent
Takasu et al.

(10) Patent No.: US 8,899,306 B2
(45) Date of Patent: Dec. 2, 2014

(54) FLASKLESS MOLDING EQUIPMENT FOR MOLDING A MOLD

(71) Applicants: Shuji Takasu, Toyokawa (JP); Yutaka Hadano, Toyokawa (JP)

(72) Inventors: Shuji Takasu, Toyokawa (JP); Yutaka Hadano, Toyokawa (JP)

(73) Assignee: Sintokogio, Ltd., Nagoya-Shi (JP)

( * ) Notice: Subject to any disclaimer, the term of this patent is extended or adjusted under 35 U.S.C. 154(b) by 0 days.

(21) Appl. No.: 14/100,200

(22) Filed: Dec. 9, 2013

(65) Prior Publication Data

US 2014/0182805 A1 Jul. 3, 2014

Related U.S. Application Data

(63) Continuation of application No. 13/575,463, filed as application No. PCT/JP2010/060463 on Jun. 21, 2010, now abandoned.

(30) Foreign Application Priority Data

Jan. 29, 2010 (JP) ..... 2010-019142

(51) Int. Cl.

| | |
|---|---|
| ***B22C 9/02*** | (2006.01) |
| ***B22C 19/04*** | (2006.01) |
| ***B22C 15/02*** | (2006.01) |
| ***B22C 11/00*** | (2006.01) |

(52) U.S. Cl.

CPC . *B22C 9/02* (2013.01); *B22C 15/02* (2013.01); *B22C 11/00* (2013.01); *B22C 19/04* (2013.01)

USPC ..... 164/456; 164/22; 164/200

(58) Field of Classification Search

CPC ..... B22C 19/04; B22C 11/00; B22C 15/02; B22C 9/02

USPC ..... 164/20–22, 37, 38, 169, 172, 173, 194, 164/195, 200–202, 456

See application file for complete search history.

(56) References Cited

U.S. PATENT DOCUMENTS

| | | | | |
|---|---|---|---|---|
| 6,675,866 | B2 | 1/2004 | Amano et al. | |
| 2004/0206472 | A1 | 10/2004 | Hirata et al. | |
| 2006/0037731 | A1 * | 2/2006 | Hirata et al. | 164/151.3 |
| 2007/0209774 | A1 * | 9/2007 | Hori et al. | 164/200 |
| 2009/0145573 | A1 | 6/2009 | Hirata et al. | |

FOREIGN PATENT DOCUMENTS

| | | | |
|---|---|---|---|
| JP | 59024552 | A | 2/1984 |
| JP | 03114312 | U | 11/1991 |

(Continued)

OTHER PUBLICATIONS

International Search Report dated Jul. 20, 2010 issued in International Application No. PCT/JP2010/060463, 2 pages.

*Primary Examiner* — Kevin E. Yoon

(74) *Attorney, Agent, or Firm* — Finnegan, Henderson, Farabow, Garrett & Dunner, L.L.P.

(57) ABSTRACT

A flaskless molding equipment for molding a mold that provides support for quickly restoring the stopped equipment to a normal operation. The control circuit monitors the movements of the movable members, the cylinders, and the mechanisms for driving a cylinder, and if the period of the operation of each step of the flaskless molding equipment for molding a mold from the start of the operation to the point where the operation of the flaskless molding equipment for molding a mold reaches the predetermined position exceeds the predetermined period that is set to be abnormal, then the control circuit provides support for restoring the stopped equipment to a normal operation, following the instructions displayed on the screen and following the operator's input by means of an input switch.

13 Claims, 24 Drawing Sheets

(56) References Cited

FOREIGN PATENT DOCUMENTS

| | | |
|---|---|---|
| JP | 06-315762 | 11/1994 |
| JP | 08-114044 | 5/1996 |
| JP | 43002181 B | 1/1998 |
| JP | 2001-293540 | 10/2001 |
| JP | 2003-136195 | 5/2003 |
| JP | 2008-100247 | 5/2008 |
| WO | WO 03/013762 A1 | 2/2003 |

* cited by examiner

FLASKLESS MOLDING EQUIPMENT FOR MOLDING A MOLD

RELATED APPLICATIONS

This is a continuation of application Ser. No. 13/575,463, filed Jul. 26, 2012, which is a section 371 of International Application No. PCT/JP2010/060463, filed Jun. 21, 2010 and claims priority of Japanese Application No. 2010-019142, filed Jan. 29, 2010, the contents of all of which are incorporated herein by reference.

TECHNICAL FIELD

This invention relates to flaskless molding equipment for molding a mold comprising a combined circuit that comprises a pneumatic circuit and an oil hydraulic circuit.

BACKGROUND OF THE INVENTION

The flaskless molding equipment for molding a mold comprising a combined circuit that comprises a pneumatic circuit and an oil hydraulic circuit is smaller than equipment for molding a mold with a molding flask, and its molding line is shorter than that of the equipment for molding a mold with a molding flask. So, the overall cost of the initial investment and the running cost can be less.

For these reasons foundries of many small- and medium-sized enterprises use this type of molding equipment. Moreover, recently many developing countries set up foundries that very often adopt flaskless molding equipment for molding a mold comprising a combined circuit that comprises a pneumatic circuit and an oil hydraulic circuit.

In large enterprises, normally personnel that specifically attend to the maintenance of the equipment are stationed round the clock. But in small- and medium-sized enterprises, most likely an operator of the equipment is assigned also to the job of maintaining the equipment. In very small companies even a sales person of the manufacturer of the equipment very often takes care of the maintenance of the equipment.

For these reasons, there used to be a problem in that a business entity that introduced flaskless molding equipment for molding a mold lacked experienced maintenance personnel, so that it took much time not only to repair the equipment or to restore it to the normal operation, but also to determine the cause of the trouble in the equipment.

Also, in the developing countries, experienced maintenance personnel are rare to find. So, it very often makes it difficult even to determine what causes the equipment to stop operating.

The companies, domestic as well as overseas, which have introduced the equipment, frequently ask the manufacturer how the equipment can be restored to its normal operation. Although the report on the current state of the equipment from users, and the manufacturers' advice on how to restore it to a normal operation, are normally exchanged by phone, etc., it usually takes much time. It takes more time before the equipment is restored to a normal operation, particularly if the user is a company located overseas and also because of the difference in languages and the time difference that exists between the user and the manufacturer. The following documents, Patent Documents 1 and 2, relate to the invention of this application.

RELATED DOCUMENTS

Patent Documents

Patent Document 1: JP 2003-136195
Patent Document 2: JP 2008400247

SUMMARY OF THE INVENTION

Problem to be Solved by the Invention

To resolve the problems, the present invention is to provide flaskless molding equipment for molding a mold comprising a combined circuit that comprises a pneumatic circuit and an oil hydraulic circuit, where, if the equipment has a trouble in its operation and stops, a support starting from determining the cause of the stoppage of the equipment until restoring the equipment to a normal operation is provided.

Means to Solve the Problem

This invention relates to flaskless molding equipment for molding a mold where support for restoring the stopped equipment to a normal operation is provided, the equipment comprising:

- a plurality of movable members that carry out work starting from molding a mold from molding sand to pushing the molds onto a transporting line,
- cylinders for a movable member that move each movable member;
- a mechanism for driving a cylinder that drives each cylinder, the mechanism for driving a cylinder comprising a pneumatic circuit, or a combined circuit comprising a pneumatic circuit and an oil hydraulic circuit;
- a control circuit that controls the electrical current to a solenoid valve that constitutes the mechanism for driving, a cylinder; and
- an operation panel that has a display and an input switch and that receives a command signal from the control circuit and sends an input signal received from the input switch to the control circuit;
- wherein the control circuit monitors the movements of the movable members, the cylinders, and the mechanisms for driving a cylinder; and
- wherein if the period of the operation of each step of the flaskless molding equipment for molding a mold from the start of the operation to the point where the operation of the flaskless molding equipment for molding a mold reaches the predetermined position exceeds the predetermined period that is set to be abnormal, then the control circuit provides support for restoring the stopped equipment to a normal operation, following the instructions displayed on the screen and following the operator's input by means of the input switch.

The control circuit monitors the movements of the movable members, the cylinders, and the mechanisms for driving a cylinder. By the present invention, the control circuit is to provide support for restoring the stopped equipment to a normal operation, following the instructions on the display and following the operator's input by means of the input switch, if the period of the operation for each step of the flaskless molding equipment for molding a mold from the start of the operation to the point where the operation of the flaskless molding equipment for molding a mold reaches the predetermined position exceeds the predetermined period that is set to be abnormal. So, the equipment that has been stopped can be quickly restored to a normal operation.

The cylinders comprise a cylinder for squeezing a set of flasks. The mechanism for driving a cylinder for squeezing a set of flasks, which mechanism drives the cylinder for squeezing a set of flasks, comprises the combined circuit comprising the pneumatic circuit and the oil hydraulic circuit. When the steps of the operation of the cylinder for squeezing a set of flasks are shown on the display, the screen shows the cylinder for squeezing a set of flasks. So, it is clearly known that the equipment contains a cylinder for squeezing a set of flasks. Also, from the screen that shows the steps of the operation it is clearly seen whether the cylinder for squeezing a set of flasks is active.

Also, if the display is arranged to show whether the conditions for the upward movement of the cylinder for squeezing a set of flasks are complied with, one can see whether the cylinder for squeezing a set of flasks can be operational. If it is not optional, one can determine what obstructs the compliance with the conditions.

If the display is arranged to show a screen showing support for restoring the stopped equipment to a normal operation, one can determine the cause of the stoppage of the equipment. If the cause of the stoppage of the equipment is simple and thus its solution is simple, then to determine the cause and to restore the equipment to a normal operation can be quickly carried out, based on the operations by means of the display screen and also by the inspection of the equipment on site. Also, if the stoppage is caused because of any defective part of the cylinder for squeezing a set of flasks, or a malfunctioning or breakdown of the valves of the pneumatic circuit or of the oil hydraulic circuit or a failure in the electrical system, one can determine the cause and can quickly restore the equipment that has stopped to a normal operation, by accessing a flow chart that can determine the cause of the stoppage of the equipment.

Further, if the flow chart, based on which the cause of the stoppage can be determined, is shown, even if a person were not experienced in the maintenance of such equipment, the cause of the stoppage of the equipment could still be determined.

If the display is arranged to show the operation of an actuator in the screen showing support for restoring the stopped equipment to a normal operation, one can determine whether the instructions to activate it have been given from the control circuit.

If the display is arranged to show in the screen showing support for restoring the stopped equipment to a normal operation, a part showing that an electric signal is being supplied to a valve connector, one can determine whether the electric signal has reached the valve connector. Depending on the determination, one can see whether the stoppage of the equipment is caused by the malfunctioning of the valve connector, or by any defect in wiring or electrical parts that are disposed between the control circuit and the valve connector, or one can see whether the wiring and electrical parts are working normally.

Further, if the instructions to determine the cause are given, even if a person were not experienced in maintenance nor specialized in that job, that person could still determine whether the cause of the stoppage of the equipment is due to a defective electrical part.

If the display is arranged to show in the screen showing support for restoring the stopped equipment to a normal operation whether there is any article or obstacle that interferes or obstructs the movement of the actuator or work (product), one can determine whether the stoppage of the equipment is caused by interference with the operation of the actuator. Moreover, if the instructions to determine the cause of the stoppage are given, then even if a person were not experienced in maintenance or specialized in that job, that person could still determine whether the stoppage of the equipment is caused by any interference with the actuator.

If the display is arranged to show in the screen showing support for restoring the stopped equipment to a normal operation, whether air and oil are being supplied by the valves, one can see whether the stoppage is caused. by an insufficient supply of fluids to the actuator. Also, if the stoppage was caused by the insufficient supply of the fluids, one can further investigate to see whether the insufficient supply of the fluids was caused by a malfunctioning valve or valves. If it is caused by the insufficient supply of fluids, one can investigate to see whether the insufficient supply of fluids was caused by leakage of the fluids from piping, etc. If the stoppage was not caused by the insufficient supply of the fluids, one can further investigate to see whether it was caused by trouble with the actuator's main body. Further, if the instructions to determine the cause for the stoppage of the equipment are given, then even if a person were not experienced in maintenance or specialized in that job, that person could still determine whether the stoppage of the equipment was caused by any failure in the supply of air or oil, the malfunctioning of the valve or valve(s), or trouble with the actuator's main body.

If the display is arranged to show in the screen showing support for restoring the stopped equipment to a normal operation the necessary measures, one can find appropriate measures to promptly restore the equipment to a normal operation.

If the screen showing support for restoring the stopped equipment to a normal operation is shown, the person in charge of maintenance looks at the screen as often as any trouble causes the equipment to stop, and determines the causes of the stoppage of the equipment.

So, even if the person were not experienced in the maintenance of the equipment, that person would be trained on site and would become well experienced in the maintenance of the equipment.

BRIEF DESCRIPTION OF THE DRAWINGS

FIG. 21 is the screen of the touch panel showing that the conditions for interlocking are not complied with.

FIG. 22 is the screen of the touch panel showing that the conditions for interlocking are complied with.

EMBODIMENT FOR CARRYING OUT THE INVENTION

Below the flaskless molding equipment for molding a mold in one embodiment of the present invention is explained.

A. Components of the Flaskless Molding Equipment for Molding a Mold

As in FIGS. 1-5, the flaskless molding equipment for molding a mold 100 in one embodiment of the present invention comprises a section for molding a mold 100A comprising molds consisting of an upper mold and a lower mold, a section for moving a lower flask 100B that moves a lower flask into and out of the section for molding a mold 100A, a section for pushing molds 100C that pushes out the molds that are molded by the section for molding a mold 100A, and a section for supplying molding sand 100D that supplies the molding sand to the section for molding a mold 100A.

(1) Section for Molding a Mold 100A

The flaskless molding equipment for molding a mold 100 comprises a gate-type frame 1. The gate-type frame 1 comprises connecting a lower base frame 1*a* to an upper frame 1*b*, by means of columns 1*c*, and forming them as one body. One column 1*c* is on each of the four corners of the lower base frame 1*a* of the section for molding a mold 100A when seen in the plan view of the flaskless molding equipment for molding a mold 100.

Figure 4:
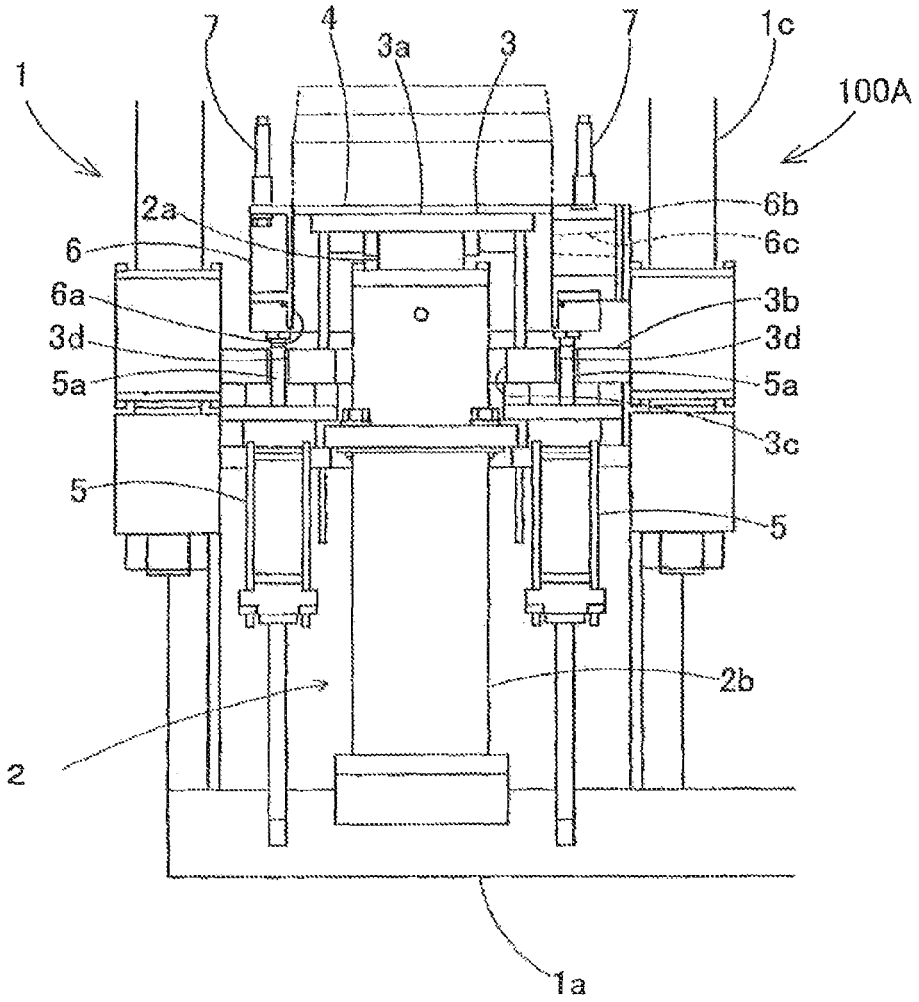
FIG. 4 is a schematic enlarged view in one embodiment of the area around the lower squeezing board of the flaskless molding equipment for molding a mold.

As in FIG. 4, the cylinder for squeezing a set of flasks 2 is disposed upright at the middle of, and on the upper surface of, the lower base frame 1*a*. A lower squeezing board 4 is attached to the upper end part 3*a* of a lower squeezing frame 3, which frame 3 is disposed on the end of a piston rod 2*a* of the cylinder for squeezing a set of flasks 2. The main body 2*b* of the cylinder for squeezing a set of flasks 2 goes through a hole for insertion 3*c* that is provided at the center of, and the lower-end part 3*b* of, the lower squeezing frame 3. Sliding bushings that are at least 10 mm high (not shown) are provided, one at each of the four corners of the lower base frame 1*a* in its plan view, thereby keeping the lower squeezing frame 3 horizontal.

Four cylinders for a lower filling frame 5 are vertically disposed at the lower-end part 3*b* of the lower squeezing frame 3, as though they surround the cylinder for squeezing a set of flasks 2. A piston rod 5*a* that is on the upper side of the cylinder for a lower filling frame 5 goes through a hole for insertion 3*d* at the lower end part 3*b* of the lower squeezing frame 3. At the end of the piston rod 5*a* a lower filling frame 6 is disposed.

The distance between the opposite inner walls 6*a* of the lower filling frames 6 becomes narrower as it goes downward so that the lower squeezing board 4 can be inserted while keeping the air-tight state. An opening for introducing molding sand 6*c* is disposed at the side wall 6*b* of the lower filling frame 6. A positioning pin 7 is disposed upright on the upper surface of the lower filling frame 6.

As seen above, the lower squeezing board 4 is attached to the upper-end part 3*a* of the lower squeezing frame 3, which frame 3 is disposed on the end of a piston rod 2*a* of the cylinder for squeezing a set of flasks 2.

The cylinder for a lower filling frame 5 is disposed at the lower-end part 3*b* of the lower squeezing frame 3 and the lower filling frame 6 is disposed at the end of a piston rod 5*a* that is on the upper side of the cylinder for a lower filling frame 5. So, when the piston rod 2*a* of the cylinder for squeezing a set of flasks extends or retracts, the lower squeezing board 4, the lower squeezing frame 3, the cylinder for a lower filling frame 5, and the lower filling frame 6 move upward or downward as one body. Also, when the upper piston rod 5*a* of the cylinder for a lower filling frame 5 extends or retracts, the lower filling frame 6 moves upward or downward.

Figure 5:
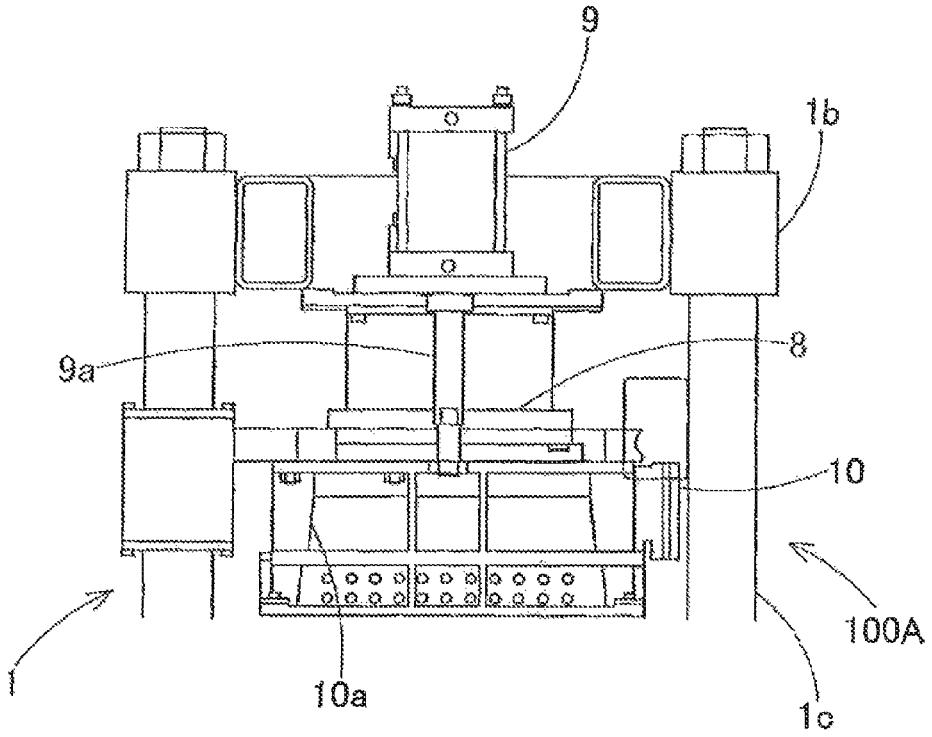
FIG. 5 is a schematic enlarged view in one embodiment of the area around the cylinder for an upper flask of the flaskless molding equipment for molding a mold.

As in FIG. 5, an upper squeezing board 8 is fixed to the lower surface of the upper frame lb. The upper squeezing board 8 is disposed above and opposite the lower squeezing board 4. A cylinder for an upper flask 9 of an air cylinder-type is disposed facing downward and fixed to the upper frame 1*b*. An upper flask 10 is attached to the end of a piston rod 9*a* of a cylinder for an upper flask 9.

The distance between the inner walls 10*a* of the upper flasks 10 increases if it moves downward, so that the upper squeezing board 8 can be inserted while keeping the air-tight state. As in FIG. 7, etc., an opening for introducing molding sand 10*c* is provided at the side wall 10*b* of the upper flask 10.

A space S is formed midway between the upper squeezing board 8 and the lower squeezing board 4, into which space a lower flask 23, which is explained below, can enter, and in which space the lower flask 23 can move upward and downward.

A pair of parallel rails for transporting 11, extend horizontally to the left and to the right. (The direction "to the left and to the to right" is based on FIG. 1. Below all other directions referred to should be understood in the same way, unless otherwise specified).

(2) Section for Moving a Lower Flask 100B

Figure 1:
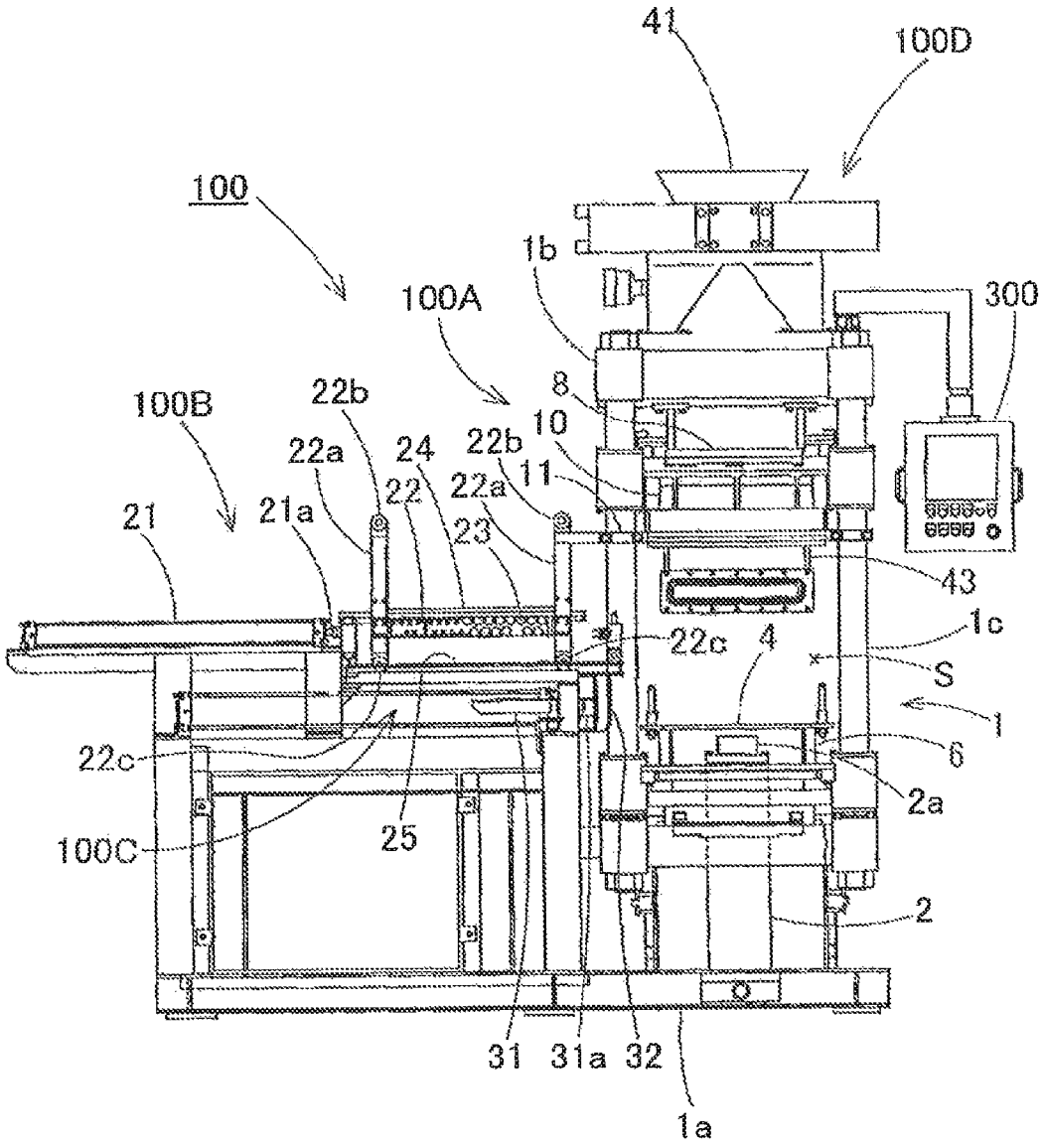
FIG. 1 is a front view in one embodiment of the flaskless molding equipment for molding a mold.

The section for moving a lower flask 100B is disposed on the left-hand side or right-hand side of columns 1*c* (in FIG. 1, it is shown on the left-hand side).

Figure 3:
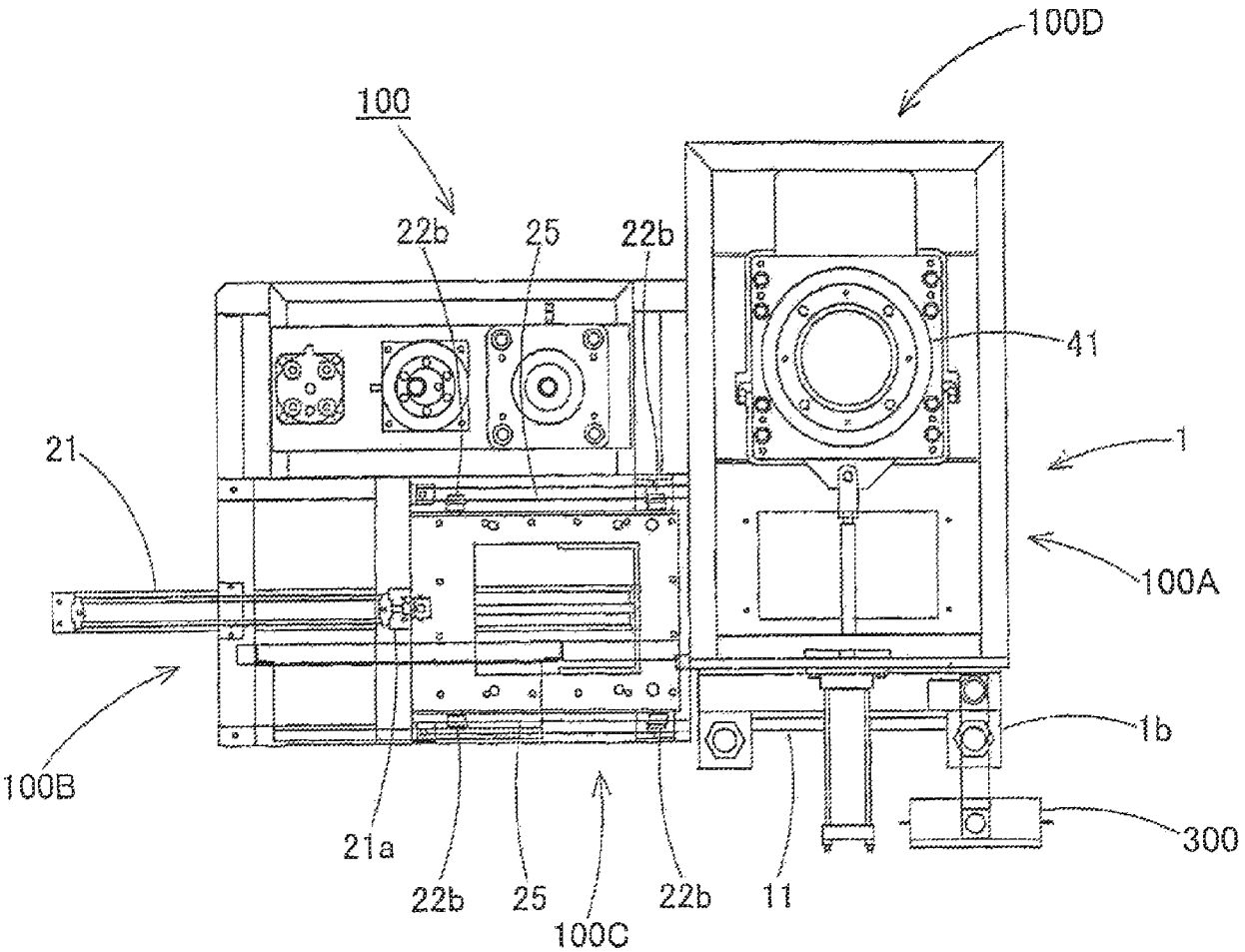
FIG. 3 is a plan view in one embodiment of the flaskless molding equipment for molding a mold.

The section for moving the lower flask 100B, which section is shown in FIGS. 1 and 3, comprises a pattern-shuttle cylinder 21. that is placed facing to the right. A master plate 22 is attached horizontally to the end of the piston rod 21*a* of the pattern-shuttle cylinder 21. The master plate 22 is attached to the end of the piston rod 21*a* so that it can be separated from the end of the piston rod 21*a* by being moved upward.

The lower flask 23 is attached to the lower surface of the master plate 22.

A match plate 24 that has a pattern on the upper surface and one on the lower surface is attached to the upper surface of the master plate 22.

The master plate 22 comprises a roller arm 22*a* that is upright, and one at each of the four corners of the section for moving the lower flask 100B when seen in a plan view. Flanged rollers 22*b* and 22*c* are respectively provided at the upper and the lower ends of each roller arm 22*a*.

The four flanged rollers 22*c* at the lower ends of the roller arms 22*a* are placed rotatably on a pair of parallel guide rails 25 that extend horizontally to the left and to the right when the piston rod 21*a* of the pattern-shuttle cylinder 21 is retracted. When the piston rod 21*a* is moving forward, the four flanged rollers 22*c* are disengaged from the pair of parallel guide rails 25 and move to the it side of the columns 1*c*.

The only two flanged rollers 22*b* on the right-hand side of the four lower flanged rollers 22*b* are at the left end of, and on the pair of, parallel rails for transporting 11 that extend from the columns 1*c*, when the piston rod 21*a* of the pattern-shuttle cylinder 21 is retracted. When the piston rod 21*a* is moving forward, the two other flanged rollers 22*b* on the left-hand side will be placed on the pair of parallel rails for transporting 11.

(3) Section for Pushing Molds 100C

The section for pushing molds 100C is disposed to the left of the columns 1*c*.

The section for pushing molds 100C comprises a cylinder for pushing molds 31, which cylinder is placed to face to the right. A pushing plate 32 is connected to the end of a piston rod 31*a* of the cylinder for pushing molds 31.

(4) Section for Supplying Molding Sand 100D

The section for supplying molding sand 100D is attached to the upper frame 1*b*.

The section for supplying molding sand 100D comprises an opening for supplying molding sand 41, a gate for molding sand 42 that opens and closes the opening for supplying molding sand 41, and an aeration tank 43 that is disposed below the gate for molding sand 42. As in FIG. 7, etc., the end part of the aeration tank 43 is formed in a biforked shape and in a two-tiered structure, thereby providing holes for supplying molding sand 43*a*.

B. A Method for Molding a Mold Using the Flaskless Molding Equipment for Molding a Mold 100

Next, the method for molding a mold using the flaskless molding equipment for molding a mold 100 is explained.

Figure 6:
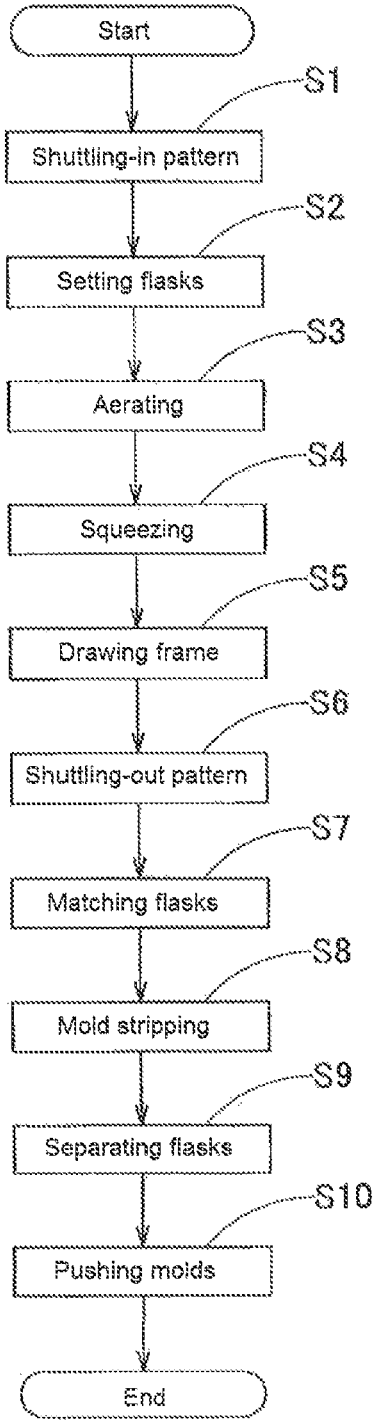
FIG. 6 is a chart showing all the steps of the method for molding a mold carried out by the flaskless molding equipment for molding a mold.

As in FIG. 6, the method for molding a mold comprises the following steps: shuttling-in a pattern S1, setting flasks S2, aerating S3, squeezing S4, drawing S5, shuttling-out a pattern S6, matching flasks S7, removing flasks S8, separating flasks S9, and pushing molds S10. Below, each step is explained in the order of these steps.

(1) At the Start (FIGS. 1, 3, 4, and 5)

For the section for molding a mold 100A, the piston rod 2*a* of the cylinder for squeezing a set of flasks 2 is at the farthest retracted position, and the lower squeezing board 4 is at the lowest position. Also, the upper piston rod 5*a* of the cylinder for a lower filling frame 5 is at the farthest retracted position and the lower filling frame 6 is at the lowest position. Also, the piston rod 9*a* of the cylinder for the upper flask 9 is at the most advanced position and the upper flask 10 is at the lowest position.

For the section for moving a lower mold 100B, the piston rod 21*a* of the pattern-shuttle cylinder 21 is at the farthest retracted position and the master plate 22, the lower flask 23, and the match plate 24 are each at the positions when the piston rod 21*a* is at its farthest retracted position.

For the section for pushing the molds 100C, the piston rod 31*a* of the cylinder for pushing molds 31 is at the farthest retracted position, and the pushing plate 32 is at the position when the piston rod is at the farthest retracted position.

Figure 7:
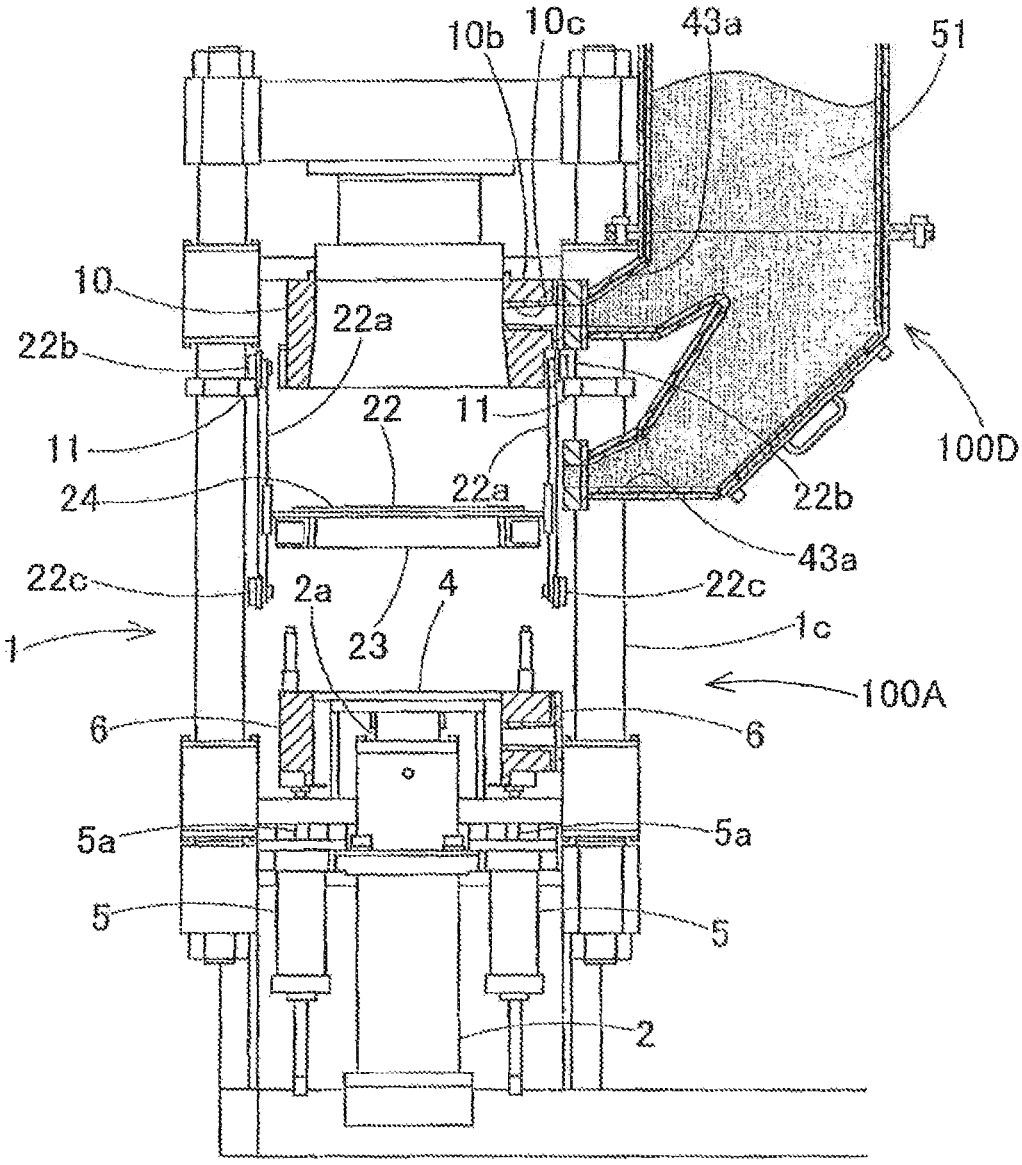
FIG. 7 is a technical illustration of the operation of the flaskless molding equipment for molding a mold where the step for shuttling-in a pattern in the method for molding a mold with a molding flask is completed.

For the section for supplying molding sand 100D, the molding sand 51 is filled in the aeration tank 43 (FIG. 7).

Figure 2:
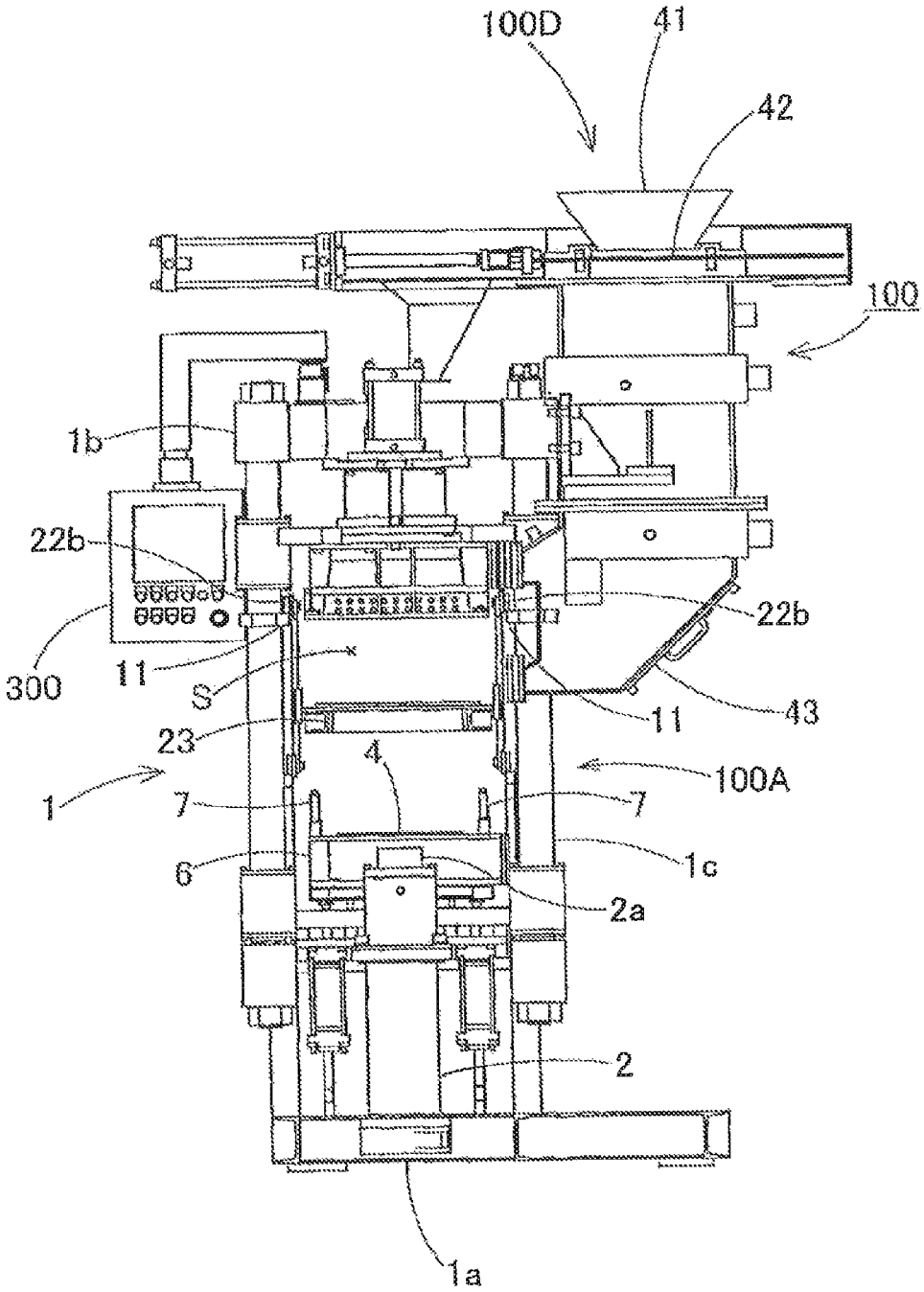
FIG. 2 is a side view in one embodiment of the flaskless molding equipment for molding a mold.

(2) Step of Shuttling-in a Pattern S1 (FIGS. 2 and 7)

The piston rod 21*a* of the pattern-shuttle cylinder 21 is moved forward. By the forward movement of the piston rod 21*a* the master plate 22 moves forward, whereby the two flanged rollers 22*b* on the left-hand side of the four upper flanged rollers 22*b* are placed on the pair of parallel rails for transporting 11 and the four lower flanged rollers 22*c* are disengaged from the pair of guide rails 25. Then when the piston rod 21*a* advances to its farthest position, the master plate 22, the lower flask 23, and the match plate 24 are set at the predetermined positions inside the columns 1*c* of the section for molding a mold 100A.

Figure 8:
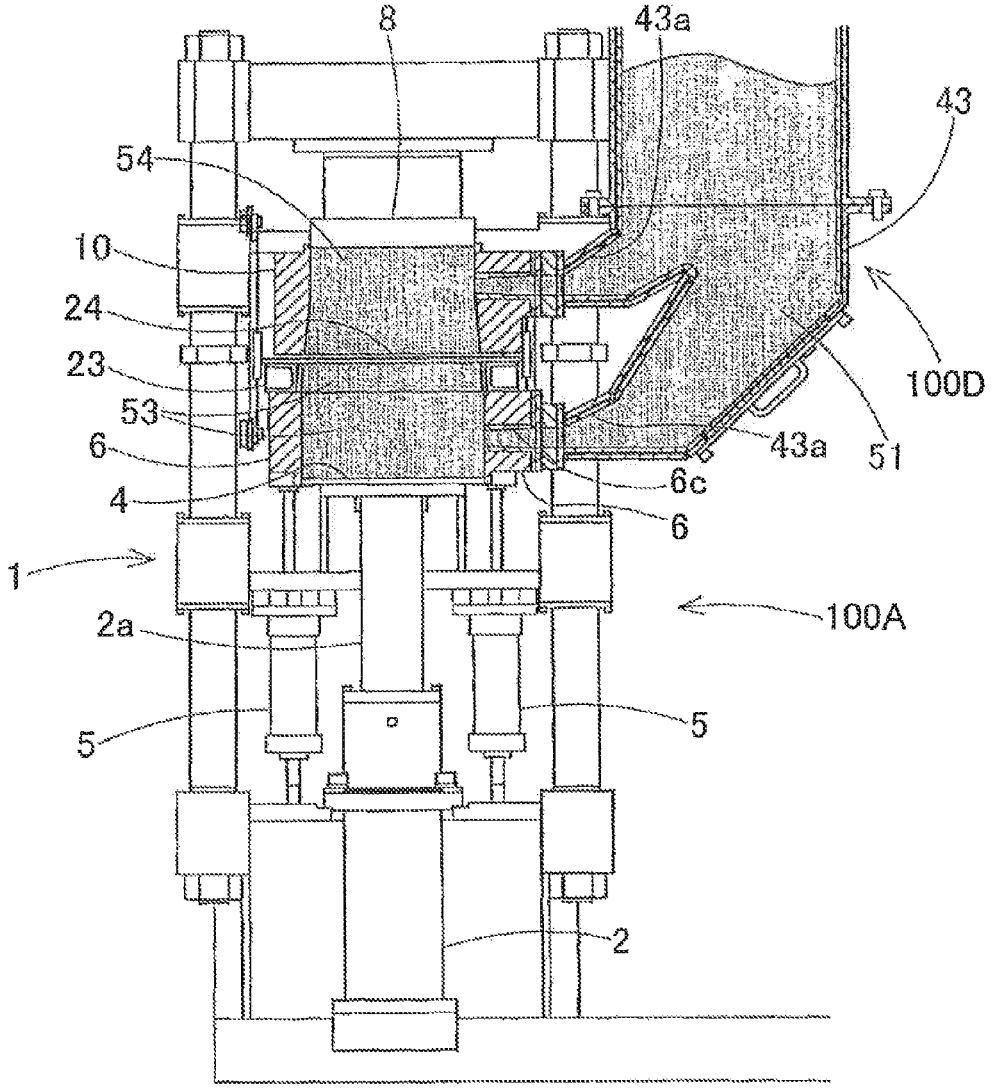
FIG. 8 is an illustration of the operation of the flaskless molding equipment for molding a mold where the step for the aeration of the method for molding a mold with a molding flask is completed.

(3) Step of Setting Flasks S2 (FIG. 8)

In this step the piston rod 2*a* of the cylinder for squeezing a set of flasks 2 is advanced so as to move the lower squeezing board 4 upward. Also, the cylinder for a lower filling frame 5 is advanced so as to move the lower filling frame 6 upward, thereby having the positioning pin 7 of the lower filling frame 6 inserted into the hole for positioning of the lower flask 23 (not shown) so as to have the lower filling frame 6 fitted to the lower surface of the lower flask 23, whereby a space for molding a lower mold that is enclosed by the lower squeezing board 4, the lower filling frame 6, the lower flask 23, and the match plate 24, is formed. The lower squeezing board 4 and the lower squeezing frame 3 are formed or fastened in one body such that when the cylinder for squeezing a set of flasks 2 moves upward, the lower squeezing frame 3 moves upward with the lower squeezing board 4.

Next, all the components that form the space for molding a lower mold are moved upward as one body, and the positioning pin 7 is inserted into the lower surface of the upper flask 10. Thereby the lower flask 23 is fitted to the lower surface of the upper flask 10 with the match plate 24 and the master plate 22 placed in between, forming a space for molding an upper mold, which space is enclosed by the upper squeezing board 8, the upper flask 10, and the match plate 24. When the space for molding an upper mold is formed, the piston rod 2*a* of the cylinder for squeezing a set of flasks 2 has not moved to its farthest end (the uppermost end).

When forming the space for molding an upper mold is complete, the opening for introducing molding sand 6*c* of the lower filling frame 6 matches the hole for supplying molding sand 43*a* of the aeration tank 43.

FIG. 8 shows that both the space for molding an upper mold and the space for molding a lower mold are filled with the molding sand, but in the step of setting flasks S2 the molding sand 51 is not yet supplied.

(4) Step of Aeration S3 (FIG. 8)

In the section for supplying molding sand 100D compressed air is supplied to the aeration tank 43 after the gate for molding sand 42 (FIG. 2) is closed. By the pressure of the compressed air the molding sand 51 in the aeration tank 43 is introduced into the space for molding a lower mold through the lower hole for supplying molding sand 43*a* and the opening for introducing molding sand 6*c* of the lower filling frame 6. Also, the molding sand 51 is introduced into the space for molding an upper mold through the upper hole for supplying molding sand 43*a* and the opening for introducing molding sand 10*c* of the upper flask 10.

In this step of aeration S3, only the compressed air is discharged through discharge spouts (not shown) that are provided on the side walls of the upper flask 10 and the lower flask 23.

Figure 9:
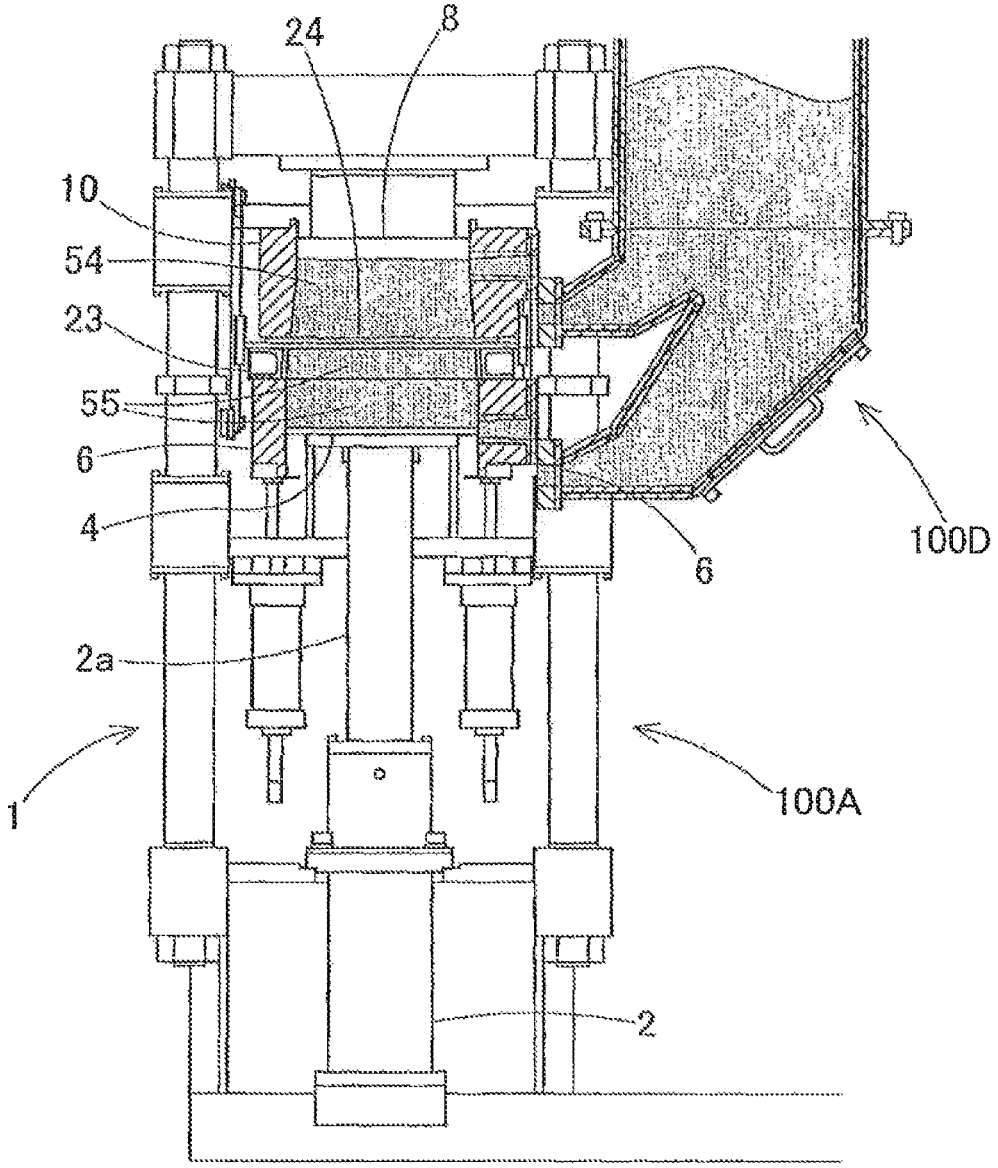
FIG. 9 is an illustration of the operation of the flaskless molding equipment for molding a mold where the step for squeezing is completed.

(5) Step of Squeezing Flasks S4 (FIG. 9)

The piston rod 2*a* of the cylinder for squeezing a set of flasks 2 is further advanced whereby the molding sand 52 within the space for molding an upper mold and the molding sand 53 within the space for molding a lower mold are squeezed by and between the upper squeezing board 8 and the lower squeezing board 4. In this step of squeezing S4, when the lower squeezing board 4 moves upward, the lower filling frame 6, the lower flask 23, the match plate 24, and the upper flask 10 also move upward until they reach their uppermost ends.

The upper mold 54 and the lower mold 55 are formed in the step of squeezing S4.

Figure 10:
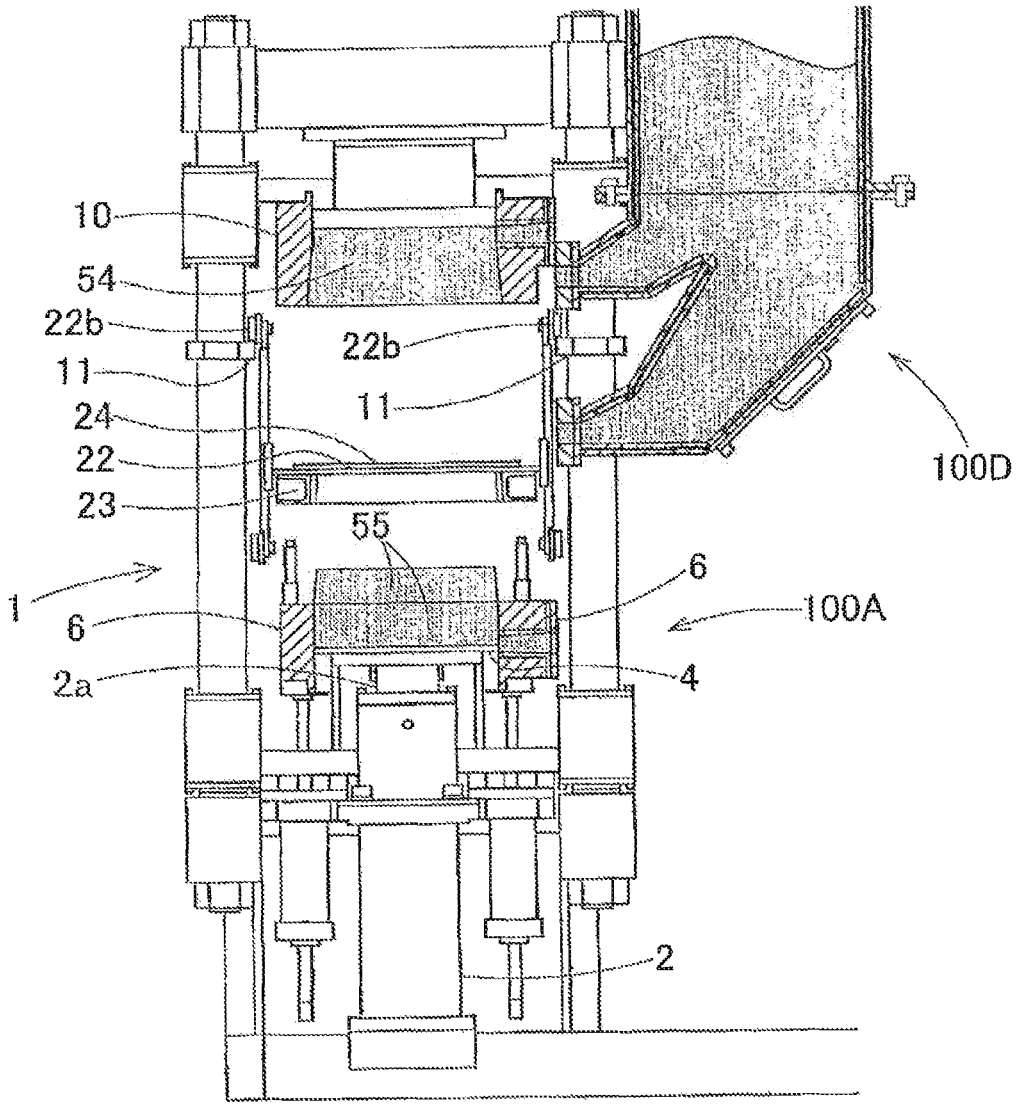
FIG. 10 is an illustration of the operation of the flaskless molding equipment for molding a mold where the step for drawing (separating molds) is completed.

(6) Step of Drawing (Separating Molds) S5 (FIG. 10)

The piston rod 2*a* of the cylinder for squeezing a set of flasks 2 is retracted to move the lower squeezing board 4 downward. While the lower squeezing board 4 is lowered, the lower flask 23, the match plate 24, the master plate 22, and the lower filling frame 6 also move downward. During the downward movement, the four flanged rollers 22*b* above the master plate 22 are placed on the pair of parallel rails for transporting 11. Then the master plate 22, the lower flask 23, and the match plate 24 stop the downward movement, while the lower squeezing board 4 and the lower filling frame 6 continue moving downward.

Figure 11:
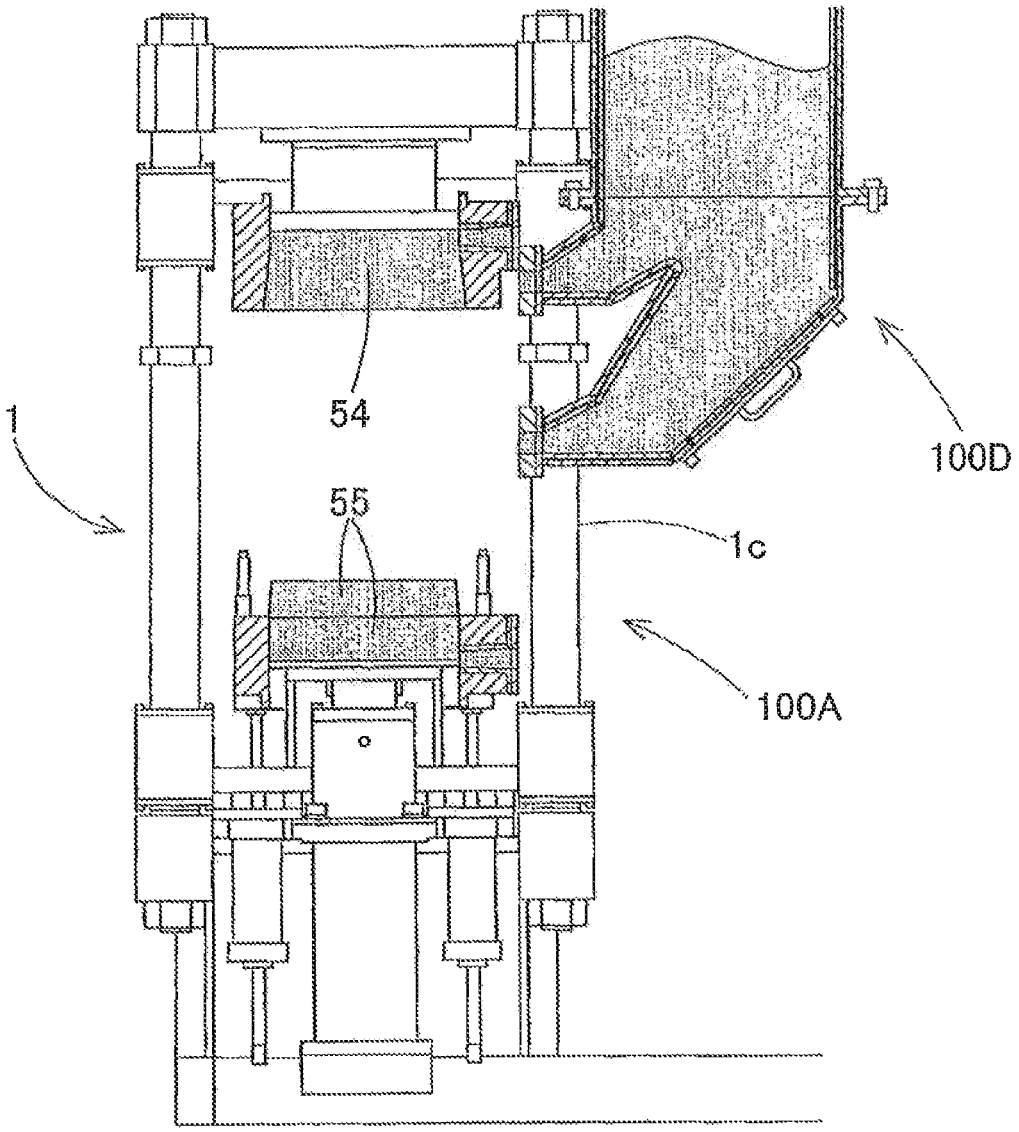
FIG. 11 is an illustration of the operation of the flaskless molding equipment for molding a mold where the step for shuttling-out a pattern is completed.

(7) Step of Shuttling-out A Pattern S6 (FIG. 11)

In the step of drawing S5, when the four flanged rollers 22*b* above the master plate 22 are placed on the pair of parallel rails for transporting 11, the master plate 22 moves to the position where it is connected to the end of the piston rod 21*a* of the pattern-shuttle cylinder 21.

In the step of shuttling-out a pattern 56, the piston rod 21*a* of the pattern-shuttle cylinder 21 is retracted to its farthest end. By the retraction of the piston rod 21*a*, the four flanged rollers 22*b* below the master plate 22 are placed on the pair of guide rails 25 while two flanged rollers 22*b* on the left-hand side of the four flanged rollers 22*b* above the master plate 22 are disengaged from the pair of parallel rails for transporting 11. Then the master plate 22, the lower flask 23, and the match plate 24 each return to the farthest end position (initial position).

After the completion of the step of shuttling-out a pattern S6, a core can be inserted into the inner side of the columns 1*c*. So, the core will be placed if it is necessary.

Figure 12:
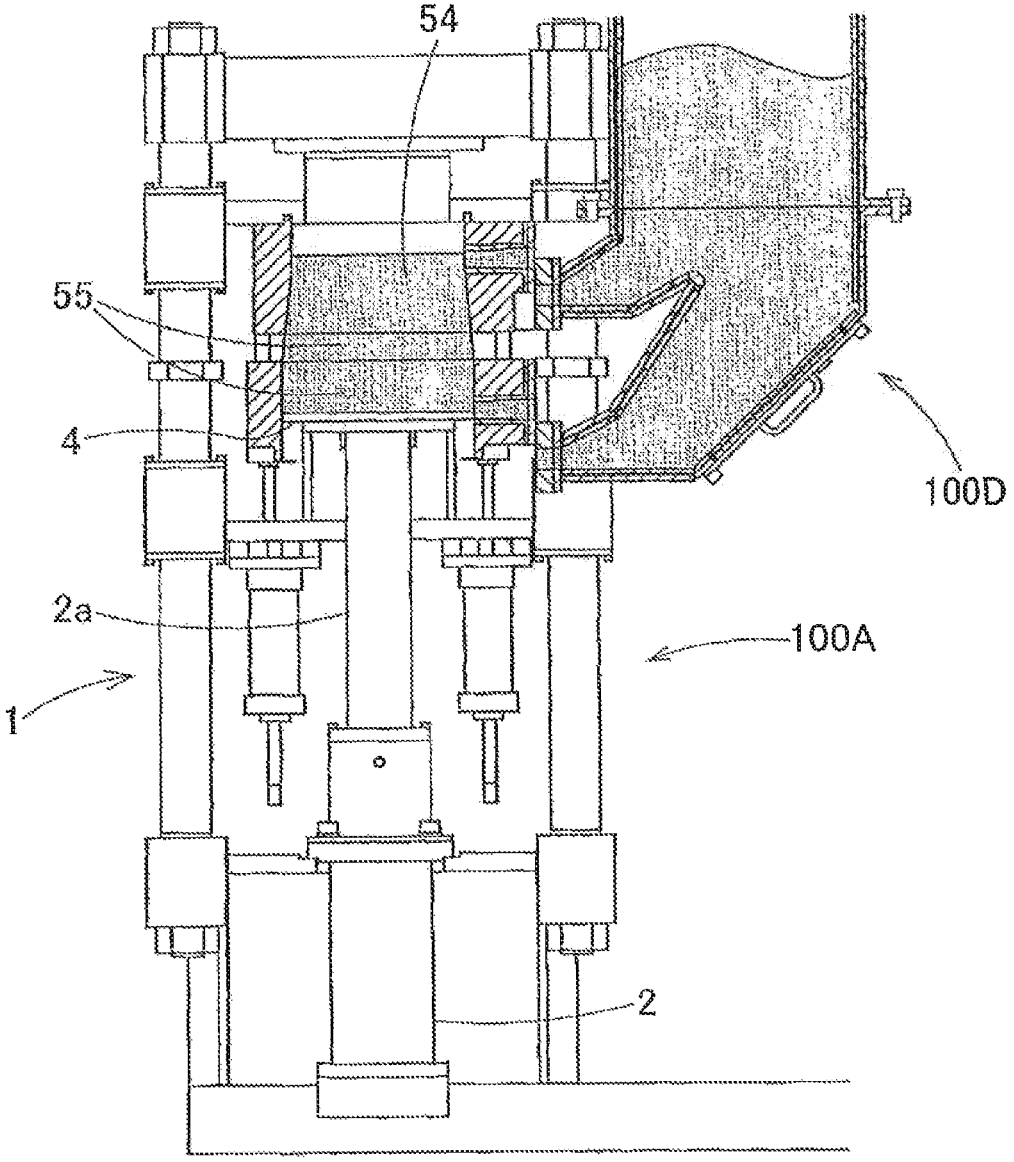
FIG. 12 is an illustration of the operation of the flaskless molding equipment for molding a mold where the step for matching flasks is completed.

(8) Step of Matching Flasks S7 (FIG. 12)

By having the piston rod 2*a* of the cylinder for squeezing a set of flasks 2 advance so as to have the lower squeezing board 4 move upward, the lower mold 55 contacts the lower surface of the upper mold 54. At this time the advancing thrust force of the cylinder for squeezing a set of flasks 2 is set to be less than that of the cylinder for squeezing a set of flasks 2 in the step of squeezing flasks S4, and also it is set to the level so that the upper mold 54 and the lower mold 55 are not crushed.

Figure 13:
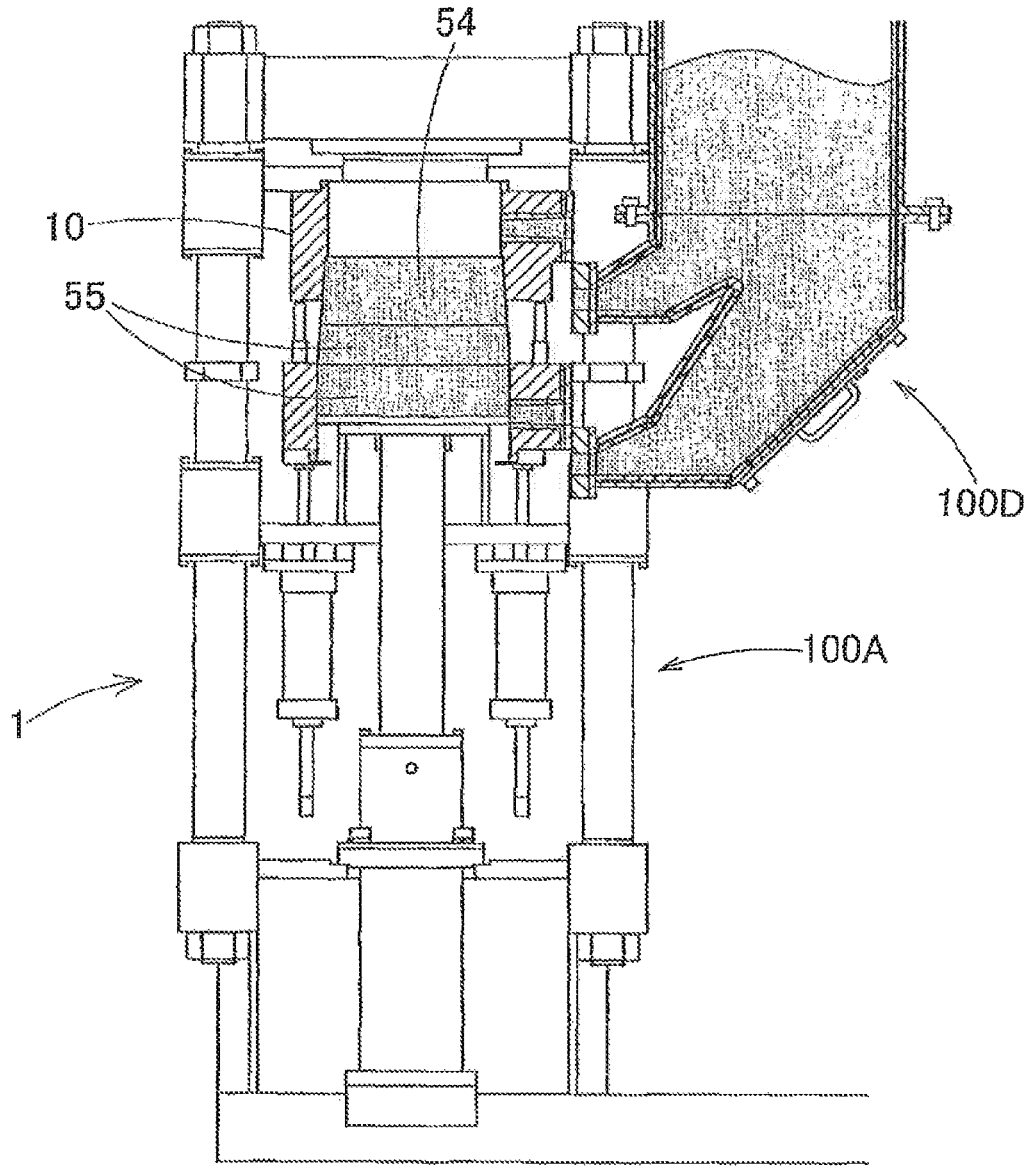
FIG. 13 is an illustration of the operation of the flaskless molding equipment for molding a mold where the process for removing flasks is completed.

(9) Step of Mold Stripping S8 (FIG. 13)

The upper flask 10 is moved upward by the piston rod 9*a* of the cylinder for an upper flask 9 being retracted. By the upward movement of the upper flask 10 the upper mold 54 is removed from the upper flask 10. After removing the upper mold 54 from the upper flask 10 the piston rod 9*a* of the cylinder for an upper flask 9 advances to have the upper flask 10 return to the lowest position (the initial position).

Figure 14:
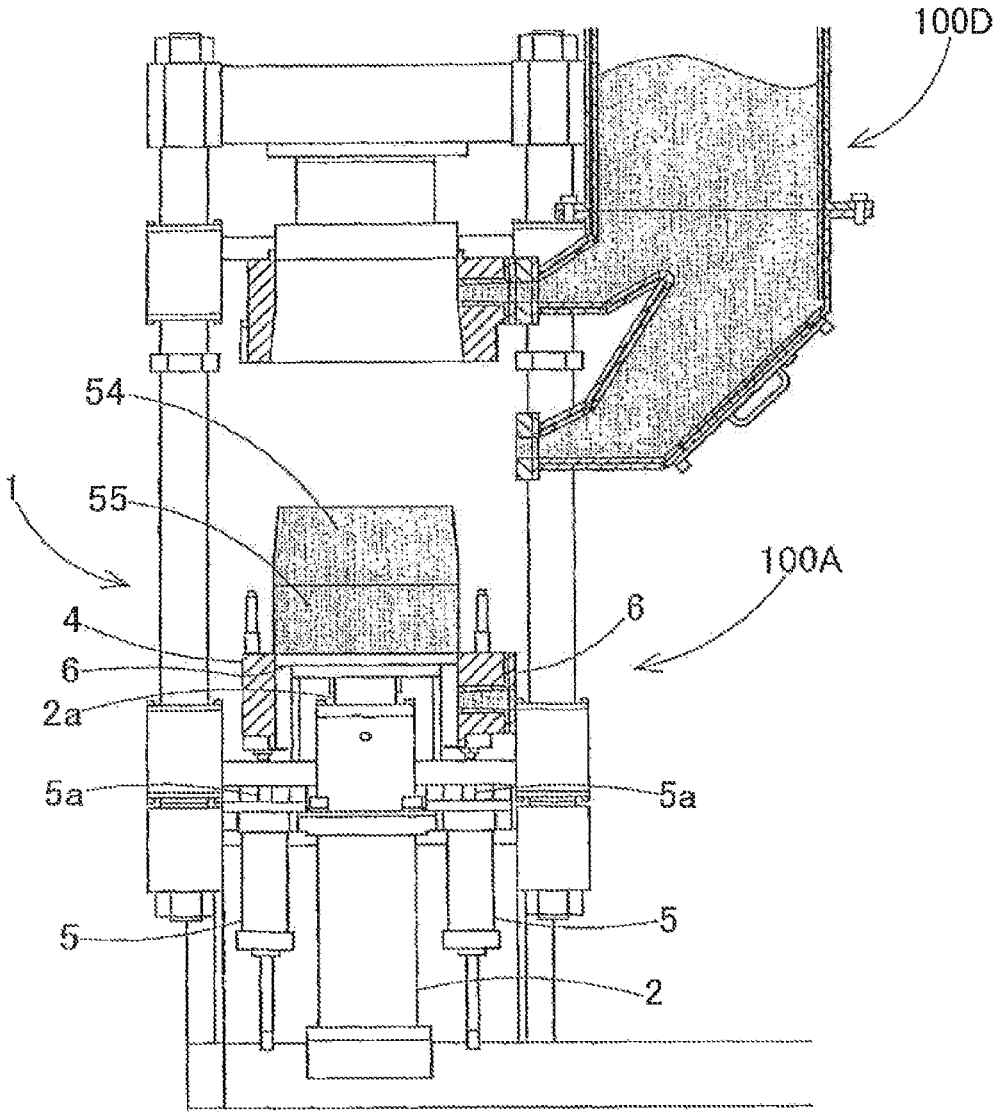
FIG. 14 is an illustration of the operation of the flaskless molding equipment for molding a mold where the step for separating flasks is completed.

(10) Step of Separating Flasks S9 (FIG. 14)

By the piston rod 2*a* of the cylinder for squeezing a set of flasks 2 being retracted, the lower squeezing board 4 returns to the lowest position (the initial position). Also, by the piston rod 5*a* that is above the cylinder for a lower filling frame 5 being retracted, the lower filling frame 6 returns to the lowest position (the initial position).

(11) Step of Pushing Molds S10

The molds (the upper mold 54 and the lower mold 55) above the lower squeezing board 4 are pushed onto a transporting line by the pushing plate 32 being advanced by the forward movement of the piston rod 31*a* of the cylinder for pushing molds 31.

C. Electrical System and Pneumatic and Oil Hydraulic Systems of the Flaskless Molding Equipment for Molding a Mold 100 (FIG. 15)

Figure 15:
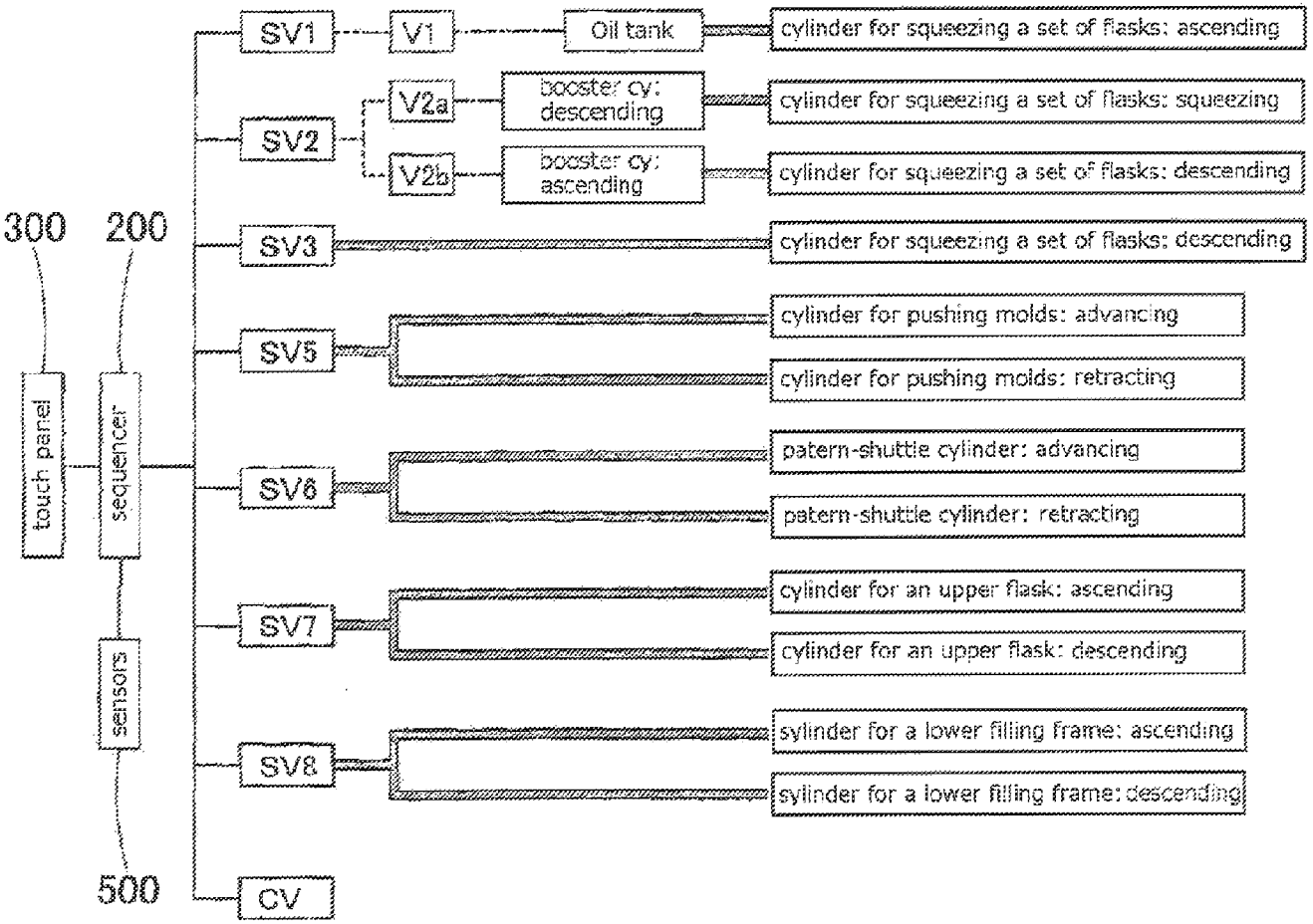
FIG. 15 is a block diagram showing the electrical system and pneumatic and oil hydraulic systems of the flaskless molding equipment for molding a mold.

As in FIG. 15, the electrical system of the flaskless molding equipment for molding a mold 100 comprises a sequencer 200 and the following items that are electrically connected to the sequencer 200: a touch panel 300 (FIGS. 1-3), solenoid valves SV1, SV2, SV3, SV5, SV6, SV7, and SV8, and a cutoff valve CV. Also, various sensors 500 are electrically connected to the sequencer 200, as, for example, a sensor that detects the initial position (the position where the cylinder retracts farthest) of the cylinder for pushing molds, a pressure switch PS, which is explained below, a pressure sensor that monitors the pressurized air to be supplied to see whether it has a pressure above the predetermined level, a lead switch or a proximity switch that monitors the position of the extended or retracted end of each cylinder, and a proximity switch that monitors the thickness of the molds so that the molds do not have a thickness that is below the predetermined levels when they are squeezed.

Figure 16:
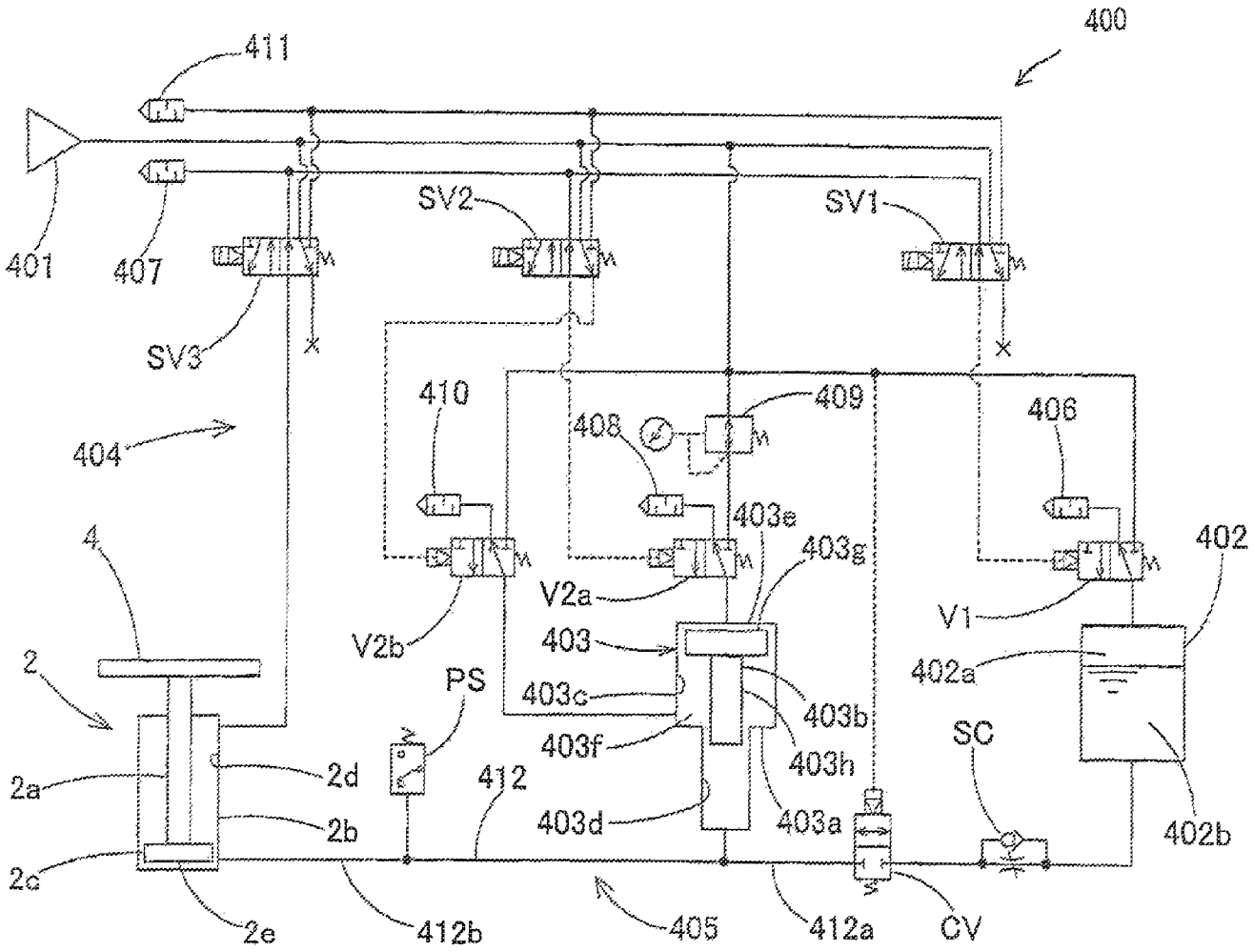
FIG. 16 shows the pneumatic circuit and the oil hydraulic circuit of the mechanism for driving a cylinder for squeezing a set of flasks.

The solenoid valves SV1, SV2, and SV3 and the cutoff valve CV, which are explained below, are components that constitute a mechanism for driving a cylinder for squeezing a set of flasks 400 that is shown in FIG. 16.

The solenoid valve SV5 supplies to and discharges from the cylinder for pushing molds 31 the compressed air, thereby moving the piston rod 31*a* forward or backward.

The solenoid valve SV6 supplies to and discharges from the pattern-shuttle cylinder 21 the compressed air, thereby moving the piston rod 21*a* forward or backward.

The solenoid valve SV7 supplies to and discharges from the cylinder for an upper flask 9 the compressed air, thereby moving the piston rod 9*a* forward (downward) or backward (upward).

The solenoid valve SV8 supplies to and discharges from the cylinder for a lower filling frame 5 the compressed air, thereby moving the piston rod 5*a* forward (upward) or backward (downward).

D. Mechanism for Driving the Cylinder for Squeezing a Set of Flasks 400 (FIG. 16)

As in FIG. 16, the mechanism for driving the cylinder for squeezing a set of flasks 400 comprises a source of compressed air 401, an oil tank 402, and a booster cylinder 403. The mechanism adopts an air-on-oil method comprising a combined circuit consisting of a pneumatic circuit 404 and an oil hydraulic circuit 405. The air-on-oil method is a multi-functional method using air pressure and oil hydraulic pressure where the air pressure is converted to the oil hydraulic pressure. The air-on-oil method does not use a specialized oil hydraulic unit that uses an oil hydraulic pump, but uses only the source of compressed air.

I) Pneumatic Circuit 404

The oil tank 402 has a pneumatic chamber 402*a* in the upper part. The pneumatic chamber 402*a* communicates with either the source of compressed air 401 or the air (silencer 406) by means of a valve V1, whose switching operation is two-position controlled, and which operation is coordinated with that of the solenoid valve SV1. The solenoid valve SV1, when no electricity is supplied, has the control port of the valve V1 communicate with a silencer 407 and keeps the valve SV1 in an inactivated state, while it has the pneumatic chamber 402*a* of the oil tank 402 communicate with the silencer 406 and keeps the pneumatic chamber 402*a* at the atmospheric pressure. The solenoid valve SV1, when electricity is supplied, has the control port of the valve V1 communicate with the source of compressed air 401 and maintains the valve V1 in an activated state while it has the pneumatic chamber 402*a* of the oil tank 402 communicate with the source of compressed air 401 and has the valve V1 supply the compressed air to the pneumatic chamber 402*a*.

A booster cylinder 403 comprises a cylinder section 403*a* and a piston section 403*b*. The cylinder section 403*a* comprises a pneumatic chamber 403*c* in the upper part and an oil hydraulic chamber 403*d* in the lower part. The ratio of the cross-sectional area of the pneumatic chamber 403*c* to that of the oil hydraulic chamber 403*d* is set, for example, as great as 10:1. The piston section 403*b* comprises a piston section 403*g* having a piston of a large diameter, which section 403*g* is disposed in the pneumatic chamber 403*c* of the cylinder section 403*a*, and which section 403*g* divides the pneumatic chamber 403*c* into an upper pneumatic chamber 403*e* and a lower pneumatic chamber 403*f*; and a piston section 40311 having a piston of a small diameter, which piston section 403*h* extends downward from the piston section 403*g* having the piston of the large diameter. The end part of the piston section 403*h* is disposed in the oil hydraulic chamber 403*d*. The booster cylinder 403 generates a hydraulic pressure that is 10 times higher compared with that of the compressed air, when the ratio of the cross-sectional area is 10:1.

The upper pneumatic chamber 403*e* of the booster cylinder 403 communicates with either the source of compressed air 401 or the atmosphere (silencer 408) by means of a valve V2*a*, whose switching operation is two-position controlled and which operation is coordinated with that of the solenoid valve SV2. When no electricity is supplied to it, the solenoid valve SV2 maintains the valve V2*a* in an inactivated state by having the control port of the valve V2 communicate with the silencer 407 and it also maintains the upper pneumatic chamber 403*e* at an atmospheric pressure by having the upper pneumatic chamber 403*e* of the booster cylinder 403 communicate with the silencer 408.

Also, when electricity is supplied, the solenoid valve SV2 maintains the valve V2*a* in an activated state by having the control port of the valve V2*a* communicate with the source of compressed air 401 and supplies the compressed air into the upper pneumatic chamber 403*e* by having the upper pneumatic chamber 403*e* communicate with the source of compressed air 401. A regulator 409 is provided on the piping for compressed air, which piping runs from the source of compressed air 401 to the valve V2*a*.

The lower pneumatic chamber 403*f* of the booster cylinder 403 communicates with either the source of compressed air 401 or the atmosphere (silencer 410) by means of a valve V2*b*, whose switching operation is two-position controlled and which operation is coordinated with that of the solenoid valve SV2. When no electricity is supplied to it, the solenoid valve SV2 maintains the valve V2*b* in an activated state by having the control port of the valve V2*b* communicate with the source of the compressed air 401, and supplies the compressed air into the lower pneumatic chamber 403*f* of the booster cylinder 403 by having the lower pneumatic chamber 403*f* communicate with the source of compressed air 401.

Also, when electricity is supplied, the solenoid valve SV2 maintains the valve S2*a* in an inactivated state by having the control port of the valve V2*b* communicate with a silencer 411 and maintains the lower pneumatic chamber 403*f* at an atmospheric pressure by having the lower pneumatic chamber 403*f* communicate with the silencer 410.

The cylinder for squeezing a set of flasks 2 comprises the main body (cylinder section) 2*b*, a piston 2*c* that is disposed within the main body 2*b*, and the piston rod 2*a* that extends upward from the piston 2*c*. As stated above, the lower squeezing board 4 is connected to the end of the piston rod 2*a*. The main body 2*b* has a pneumatic chamber 2*d* in the upper part and an oil hydraulic chamber 2*e* in the lower part, where the piston 2*c* separates the pneumatic chamber 2*d* from the oil hydraulic chamber 2*e*.

The pneumatic chamber 2*d* communicates with either the source of compressed air 401 or the atmosphere (silencer 407) by means of the solenoid valve SV3. When no electricity is supplied to it, the solenoid valve SV3 maintains the pneumatic chamber 2*d* at atmospheric pressure by having the pneumatic chamber 2*d* communicate with the silencer 407. Also, when electricity is supplied, the solenoid valve SV3 supplies the compressed air to the pneumatic chamber 2*d* by having the pneumatic chamber 2*d* communicate with the source of compressed air 401.

II) Oil Hydraulic Circuit 405

The oil hydraulic circuit 405 comprises a piping for hydraulic oil 412 that connects the oil tank 402 with an oil hydraulic chamber 2*e* of the cylinder for squeezing a set of flasks 2, wherein the piping for hydraulic oil 412 is connected to a speed controller SC and the cutoff valve CV in a section 412*a* of the piping for hydraulic oil 412, which section is the part that is closer to the oil tank 402 than to the cylinder for squeezing a set of flasks 2; and wherein the piping for hydraulic oil 412 is connected to the oil hydraulic chamber 403*d* of the booster cylinder 403 in a section 412*b* of the piping for hydraulic oil 412, which section is a part that is closer to the cylinder for squeezing a set of flasks 2 than to the oil tank 402. Also, the piping for hydraulic oil 412 is connected to the pressure switch (PS) in the section 412*b* of the piping for hydraulic oil 412.

When no electricity is supplied to it, the cutoff valve CV keeps the oil tank 402 disconnected from the oil hydraulic chamber 2*e* of the cylinder for squeezing a set of flasks 2, and it keeps the oil tank 402 disconnected from the oil hydraulic chamber 403*d* of the booster cylinder 403. Further, when electricity is supplied, the cutoff valve CV has the oil tank 402 communicate with the oil hydraulic chamber 2*e* of the cylinder for squeezing a set of flasks 2, and it keeps the oil tank 402 in communication with the oil hydraulic chamber 403*d* of the booster cylinder 403.

D. Method of Support for Restoring the Stopped Equipment to a Normal Operation in the Flaskless Molding Equipment for Molding a Mold 100 (FIGS. 17-24)

Figure 17:
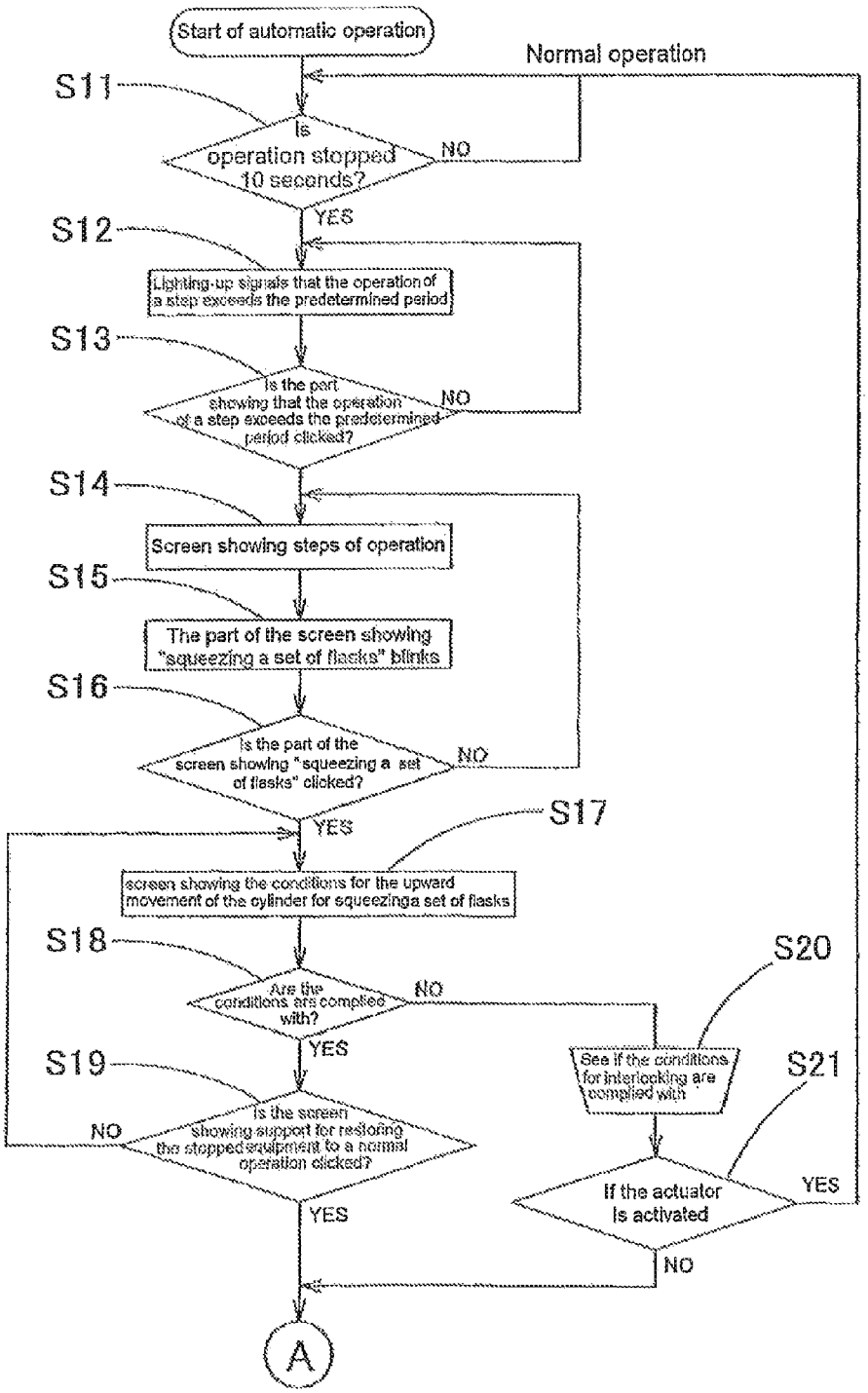
FIG. 17 is a flow chart illustrating the first half of the steps of the method of support for restoring the stopped equipment to a normal operation.
Figure 18:
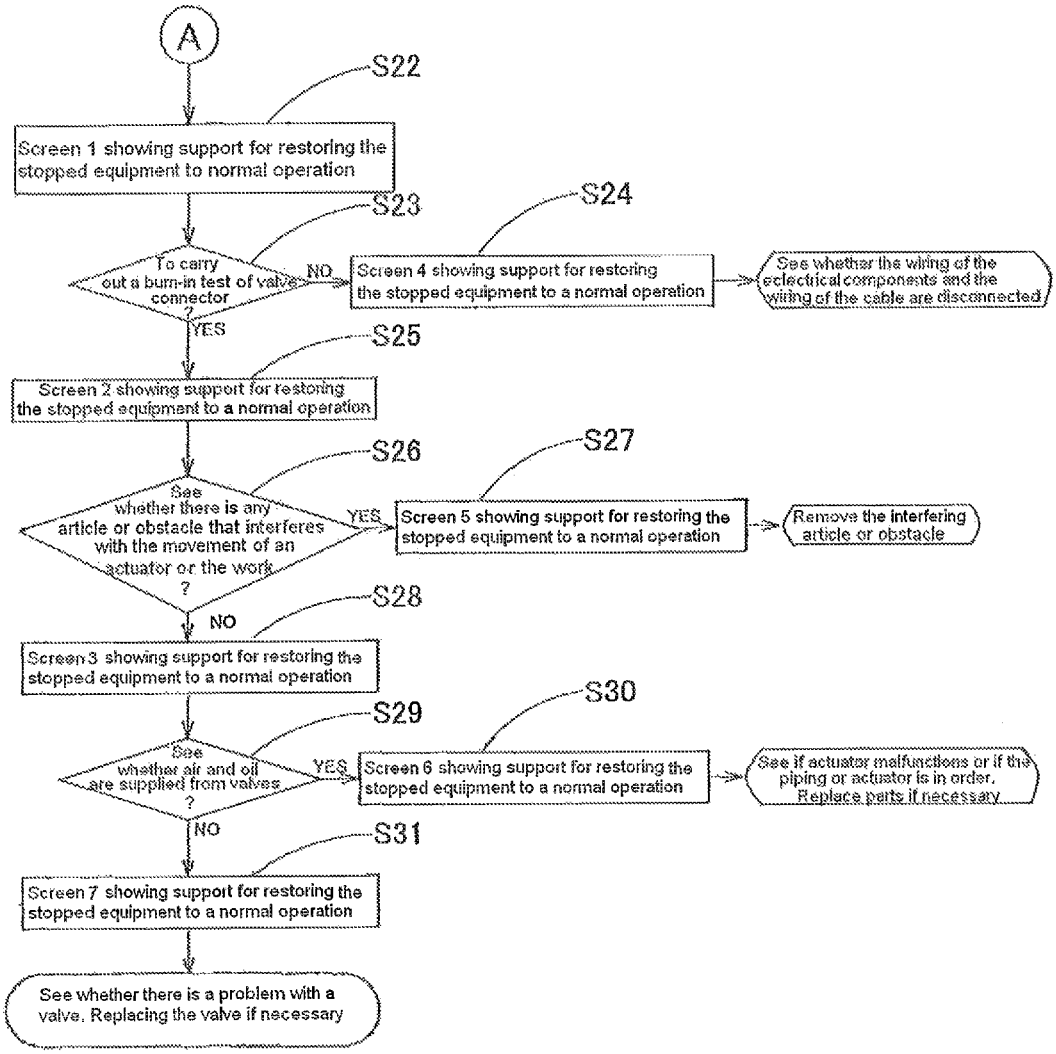
FIG. 18 is a flow chart illustrating the second half of the steps of the method of support for restoring the stopped equipment to a normal operation.
Figure 19:
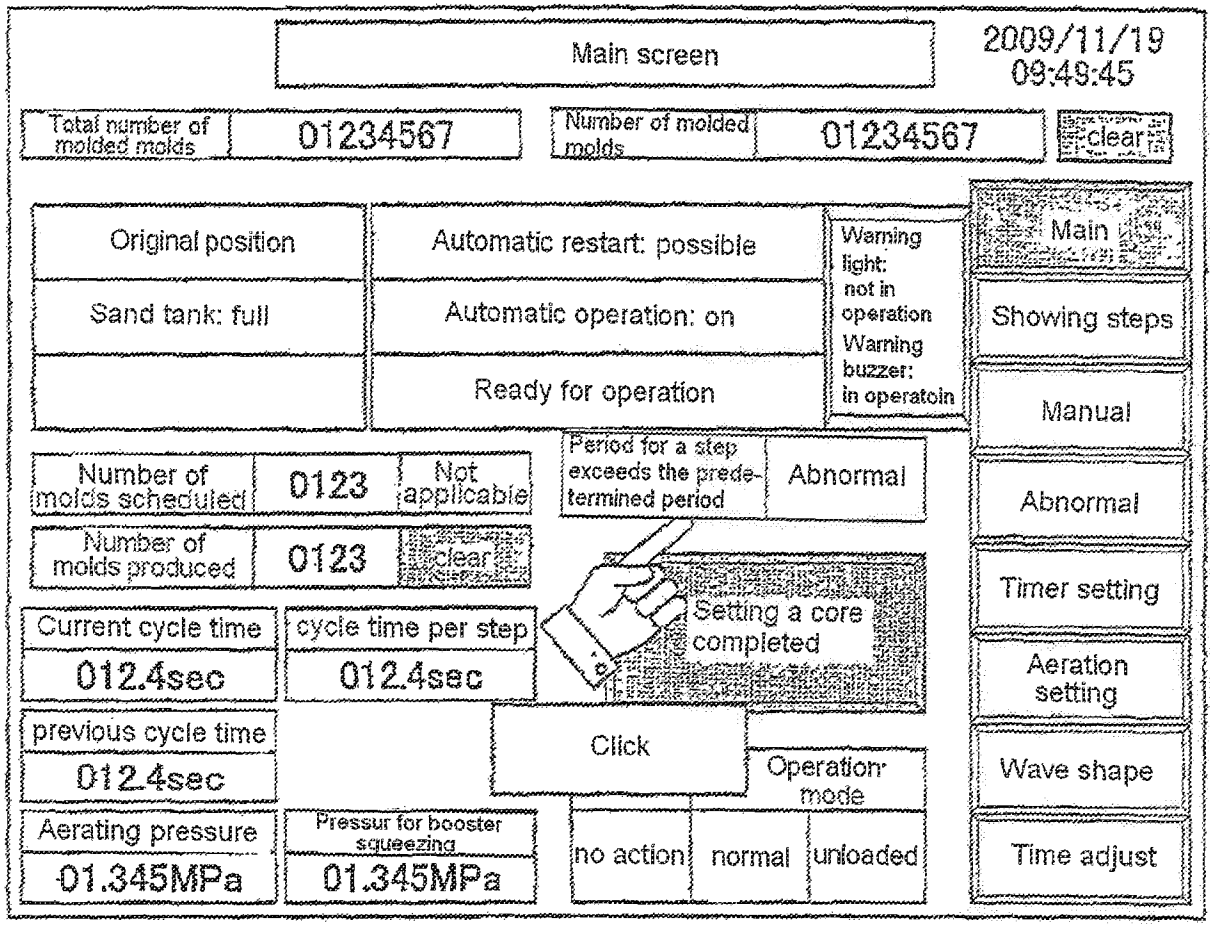
FIG. 19 is the main screen of the touch panel.

Pursuant to the procedures shown in FIGS. 17 and 18, the sequencer 200 and the touch panel 300 carry out the support for restoring the flaskless molding equipment for molding a mold 100 to a normal operation.

(1) To Determine if the Operation of a Step Exceeds the Predetermined Period (S11)

If the automatic operation starts, the sequencer 200 monitors the signals on the movement of each actuator (each cylinder) such as the cylinder for squeezing a set of flasks 2, and determines for each step of the method of molding a mold if the period of the operation of each step of the flaskless molding equipment for molding a mold from the start of the operation to the point where the operation of the flaskless molding equipment for molding a mold reaches the predetermined position exceeds the predetermined period that is set to be abnormal, as, for example, 10 seconds or more (S11).

(2) A Light Signals that the Operation of a Step Exceeds the Predetermined Period (S12)

If the sequencer 200 determines that if the period of the operation of each step of the flaskless molding equipment for molding a mold from the start of the operation to the point where the operation of the flaskless molding equipment for molding a mold reaches the predetermined position exceeds the predetermined period that is set to be abnormal, it sends to the touch panel 300 a command to light up a signal indicating that the operation of the step exceeds the predetermined period. Then the touch panel 300 that received the command lights up the part showing that the operation of the step exceeds the predetermined period (input switch) in the main screen shown in FIG. 19 (S12).

(3) To Determine if the Part Showing that the Operation of a Step Exceeds the Predetermined Period Has Been Clicked (S13)

The touch panel 300 determines if the part showing that the operation of a step exceeds the predetermined period has been clicked (S13).

(4) Screen Showing Steps of the Operation (S14)

Figure 20:
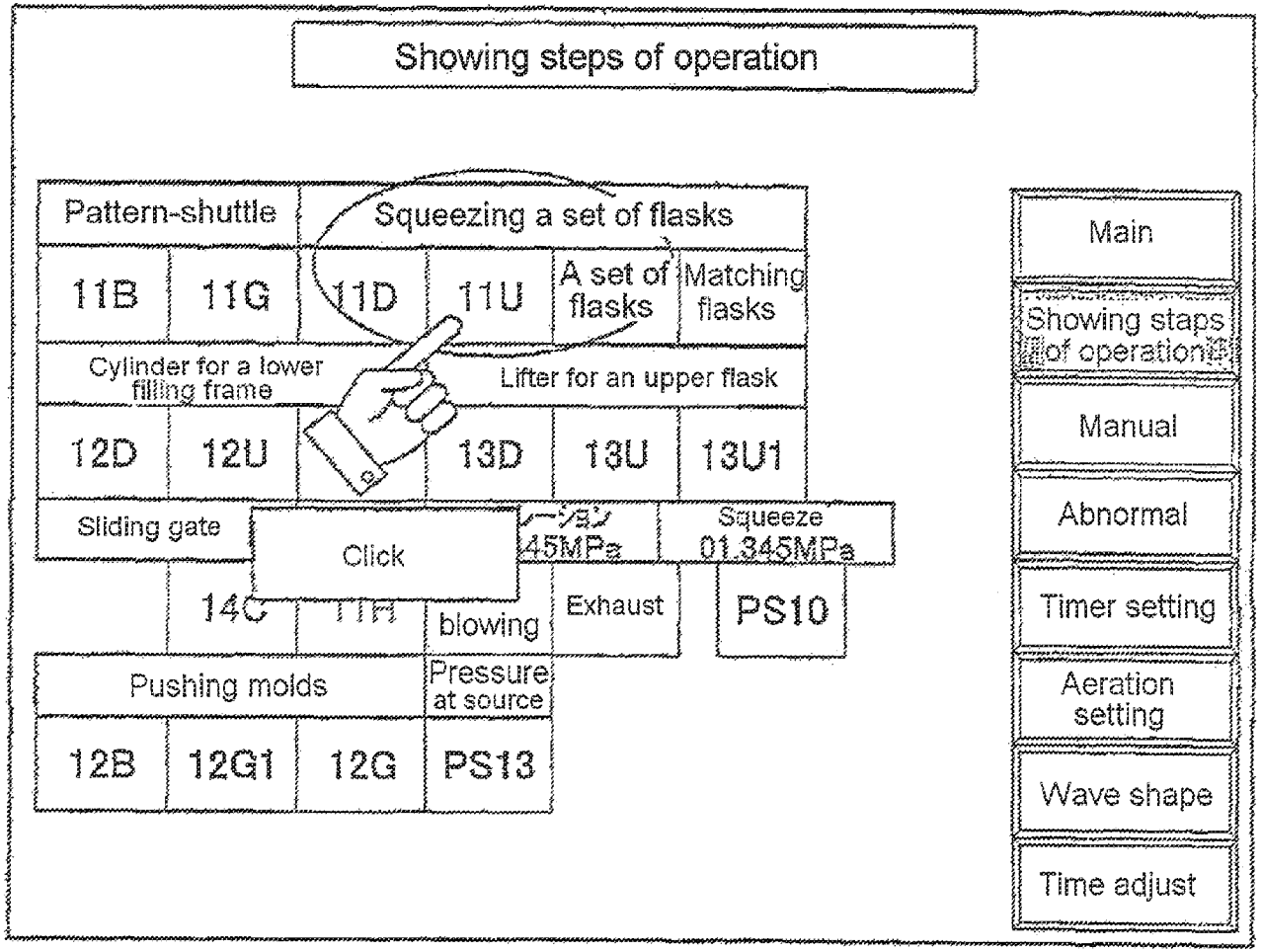
FIG. 20 is the screen of the touch panel showing the steps of the method of support for restoring the stopped equipment to a normal operation.

If the operator has clicked the part showing that a step of the operation exceeds the predetermined period, then the touch panel 300 displays the screen showing the steps as in FIG. 20 (S14).

(5) The Part of the Screen Showing "Squeezing a Set of Flasks" Blinks (S15)

The touch panel 300 has the part of the screen denoted "11U" (input switch) in the screen showing that step (S15). The blinking of the part "11U" means that the cylinder for squeezing a set of flasks 2 is moving upward in the step of squeezing a set of flasks (in the steps of setting flasks S2, squeezing flasks S4, and matching flasks 57) and the blinking of that part shows that the period of the operation of the step has exceeded the predetermined period.

(6) To Determine if the Part of the Screen Showing "Squeezing a Set Of Flasks" has Been Clicked (S16)

The touch panel 300 determines if the part "11U" has been clicked (S16).

(7) Screen Showing the Conditions for the Upward Movement of the Cylinder For Squeezing a Set of Flasks (S17)

Figure 21:
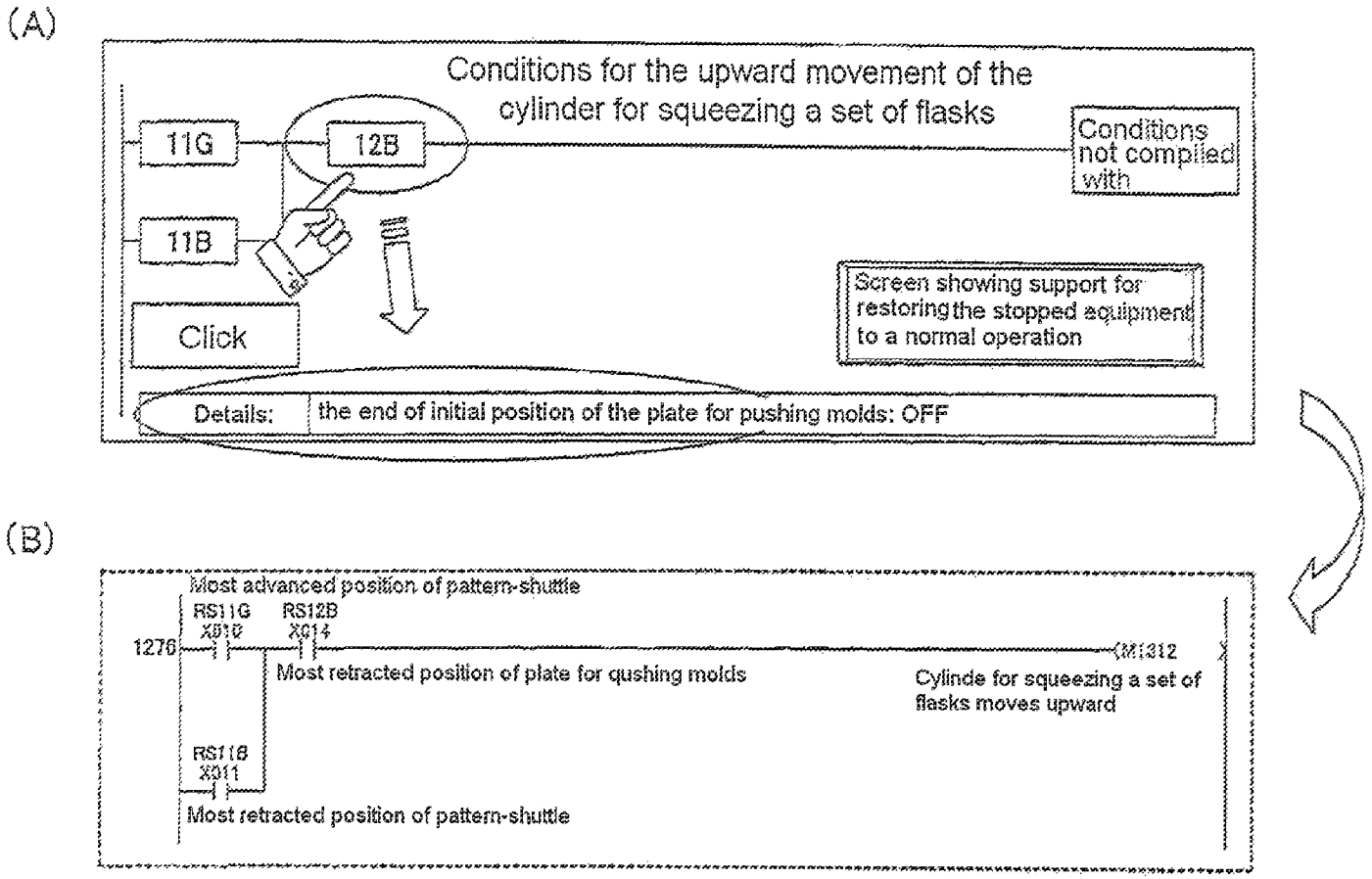

If the operator clicks the part "11U," the touch panel 300 produces the screen showing the conditions for the upward movement of the cylinder for squeezing a set of flasks as is shown in FIG. 21 (A) or 22 (S17). In FIG. 21 (A) or 22 the screen showing the conditions for the upward movement of the cylinder for squeezing a set of flasks displays an interlock circuit within the sequence ladder of the sequencer 200.

(8) To Determine if the Conditions are Complied with (S18)

The sequencer 200 determines if the conditions for interlocking are complied with (S18).

If the conditions for interlocking are not complied with, the screen shows the conditions for the upward movement of the cylinder for squeezing a set of flasks as in FIG. 21 (A). The screen showing the conditions for the upward movement of the cylinder for squeezing a set of flasks of FIG. 21 (A) displays in an unlit state the part of the screen displaying "12B" (input switch), which represents the actuator (a cylinder for pushing molds 31) that causes the conditions from being complied with. If the operator clicks the part of the screen displaying "12B," the screen as in FIG. 21 (B), which gives more detailed information, appears.

Figure 22:
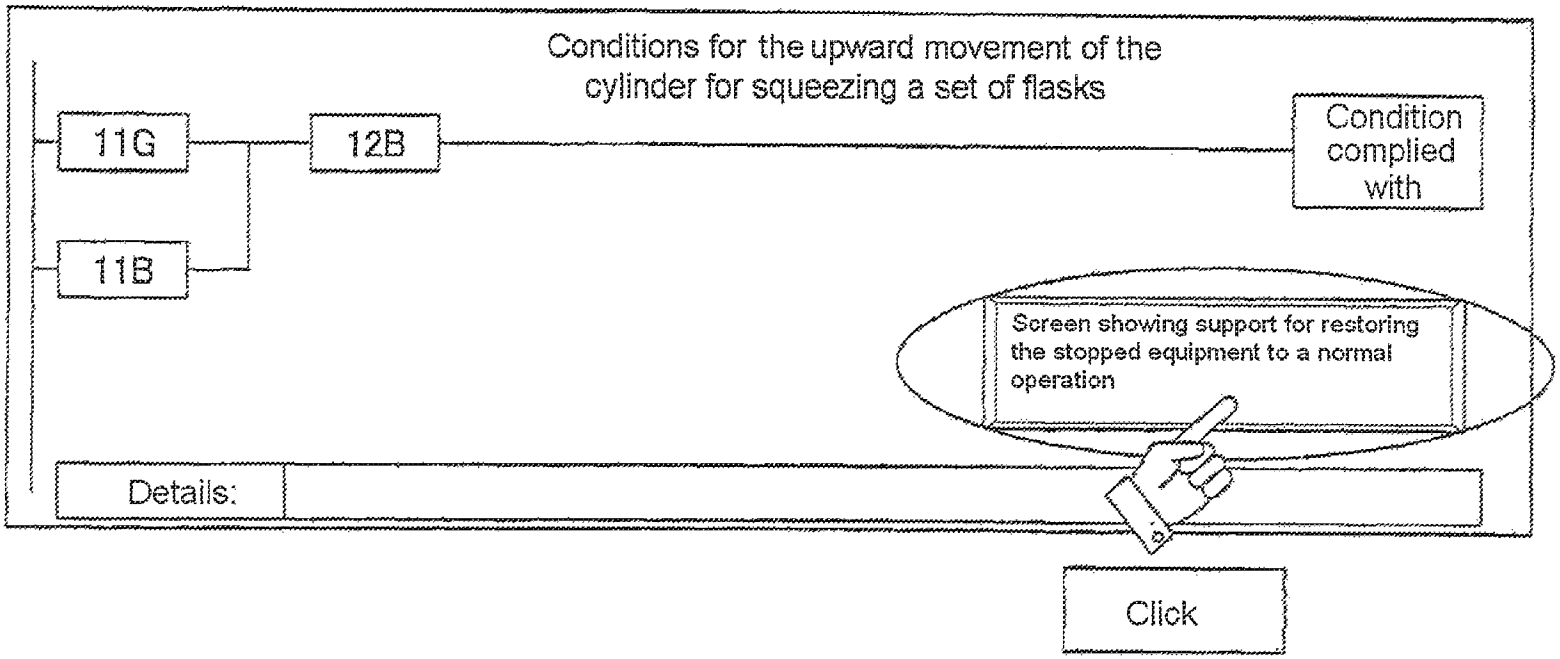

If the conditions for interlocking are complied with, the screen showing the conditions for the upward movement of the cylinder for squeezing a set of flasks, as in FIG. 22, is shown. The screen showing the conditions for the upward movement of the cylinder for squeezing a set of flasks lights up the part of the screen displaying "the conditions complied with."

(9)-a. To Determine if the Screen Showing Support for Restoring the Stopped Equipment to a Normal Operation has Been Clicked (S19)

It the conditions for interlocking are complied with, the touch panel 300 determines if the part of the screen showing support for restoring the stopped equipment to a normal operation (input switch) has been clicked by the operator (S19). If the operator has clicked the part of the screen showing support for restoring the stopped equipment to a normal operation, the step moves to Screen 1, showing support for restoring the stopped equipment to a normal operation (S22), as is explained below.

(9)-b. To Determine if the Conditions for Interlocking are Complied with and if the Actuator is Activated (S20)

If the conditions for interlocking are not complied with, the operator reviews the conditions for interlocking (S20). If the conditions are not complied with, the operator manually causes the conditions for interlocking to be complied with. Then if the conditions for interlocking are complied with, and if the equipment is restarted, the flaskless molding equipment for molding a mold returns to a normal operation. However, even if it is restarted, but the actuator does not start working, the screen shows the instructions (S21) instructing the operator to click the screen showing support for restoring the stopped equipment to a normal operation (input switch). If the operator clicks the screen showing support for restoring the stopped equipment to a normal operation, the step moves to Screen 1, showing support for restoring the stopped equipment to a normal operation (S22), as is explained below.

(10) Screen 1 Showing Support for Restoring the Stopped Equipment to Normal Operation (S22)

Figure 23:
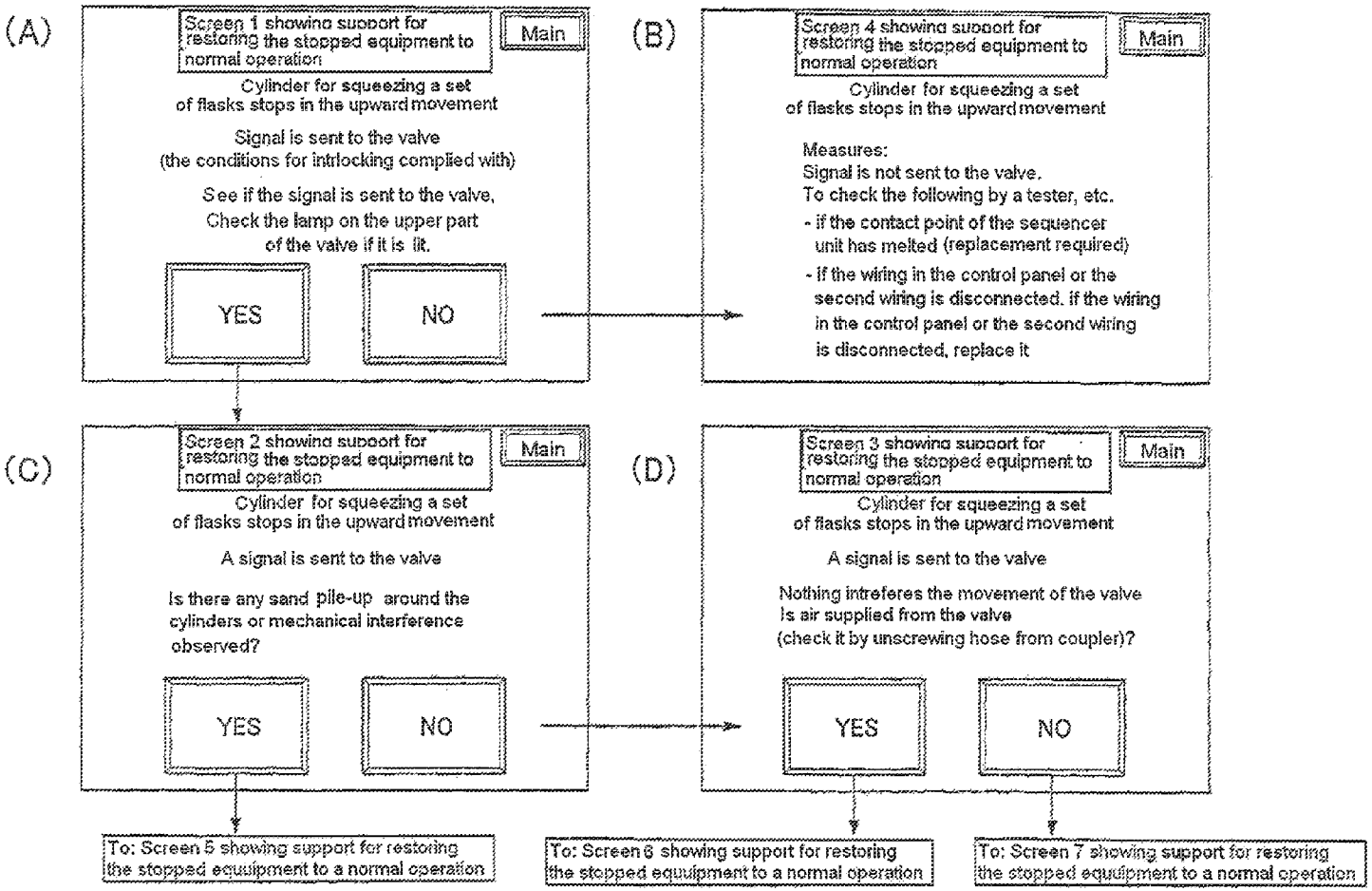
FIG. 23 shows the screen showing the transition in the first half of the support for restoring the stopped equipment to a normal operation.

The touch panel 300 displays Screen 1 showing support for restoring the stopped equipment to a normal operation as in FIG. 23 (A) (S22). Screen 1, showing support for restoring the stopped equipment to a normal operation, displays these messages: "Signal is sent to the valve (the conditions for interlocking complied with)," "To see if the signal is sent to the valve, see if the lamp on the upper part of the valve is on," and displays a "YES" button (input switch) and a "NO" button (input switch).

(11) To Carry Out a Burn-in Test of Valve Connector (S23)

The operator sees whether the lamp on the upper part of the valve is on, based on Screen 1, showing support for restoring the stopped equipment to a normal operation. If the lamp on the upper part of the valve is not on, the operator clicks the "NO" button. If the lamp on the upper part of the valve is on, the operator clicks the "YES" button (S23).

(12)-a Screen 4 Showing Support for Restoring the Stopped Equipment to a Normal Operation (S24)

If the "NO" button is clicked in Screen 1, showing support for restoring the stopped equipment to a normal operation, the touch panel 300 displays the Screen 4, showing support for restoring the stopped equipment to a normal operation (S24) as shown in FIG. 23 (B).

Screen 4, showing support for restoring the stopped equipment to a normal operation, displays these messages: "Measures: Signal is not sent to the valve. To check by a tester, etc.," "See if the contact point of the sequencer unit has melted" (replacement required)," and "See if the wiring in the control panel or the second wiring is disconnected. if the wiring in the control panel or the second wiring is disconnected, replace it if necessary."

The operator, upon seeing this screen, determines whether the wiring of the electrical components and the wiring of the cable are disconnected.

(12)-b Screen 2 Showing Support for Restoring the Stopped Equipment to a Normal Operation (S25)

If the "Yes" button is clicked in Screen 1, showing support for restoring the stopped equipment to a normal operation, the touch panel displays Screen 2, showing support for restoring the stopped equipment to a normal operation (S25). Screen 2, showing support for restoring the stopped equipment to a normal operation displays these messages: "A signal is sent to the valve," "Is there any sand pile-up around the cylinders or mechanical interference observed?" and displays a "Yes" button (input switch), and a "No" button (input switch).

To determine whether there is any article or obstacle that interferes or obstructs the movement of the actuator or the work (S26)

The operator, by monitoring Screen 2, showing support for restoring the stopped equipment to a normal operation, visually checks whether there is any sand piled up around the cylinder or any mechanical interference (S26). If there is a sand piled up around the cylinders or mechanical interference, the operator clicks the "Yes" switch. If there is no sand piled up around the cylinders or mechanical interference, the operator clicks the "No" switch.

(14)-a) Screen 5 Showing Support for Restoring the Stopped Equipment to a Normal Operation (S27)

When the "Yes" button is clicked in. Screen 2, showing support for restoring the stopped equipment to a normal operation, the touch panel produces Screen 5, showing support for restoring the stopped equipment to a normal operation (S27), as in FIG. 24 (A), Screen 5, showing support for restoring the stopped equipment to a normal operation, displays these messages: "Measures: movement of a cylinder is disturbed, Remove the interfering article or substance."

The operator, seeing the instructions on the screen, removes the interfering article or substance.

(14)-b Screen 3 Showing Support for Restoring the Stopped Equipment to a Normal Operation (S28)

If the "No" button is clicked in Screen 2, showing support for restoring the stopped equipment to a normal operation, the touch panel produces Screen 3, showing support for restoring the stopped equipment to a normal operation (S28), as in FIG. 23 (B). Screen 3, showing support for restoring the stopped equipment to a normal operation displays these messages: "A signal is sent to the valve," "Nothing interferes the movement of the valve," and "Is air supplied from the valve (check it by unscrewing a hose from a coupler)?" and displays a "Yes" button (input switch) and a "No" button (input switch).

(15) To Determine if Air and Oil Are Supplied from Valves (S29)

The operator, by monitoring Screen 3, showing support for restoring the stopped equipment to a normal operation, determines whether the air and oil are supplied from the valve(s). If they are supplied, the operator clicks the "Yes" button. If neither is supplied, the operator clicks the "No" button.

(16)-a Screen 6 Showing Support for Restoring the Stopped Equipment to a Normal Operation (S30)

Figure 24:
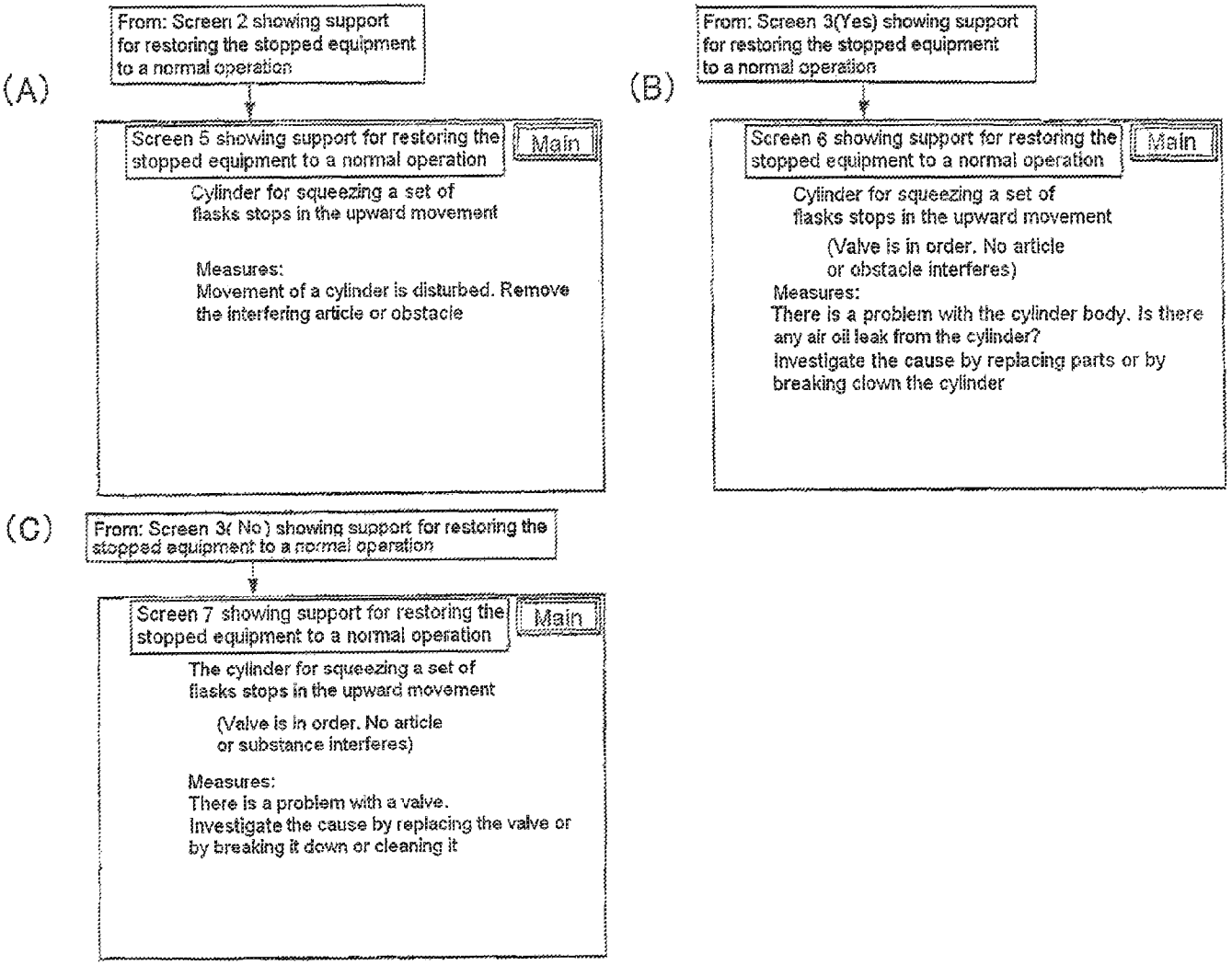
FIG. 24 shows the screen showing the transition in the second half of the support for restoring the stopped equipment to a normal operation.

If the "Yes" button is clicked in Screen 3 showing support for restoring the stopped equipment to a normal operation, the touch panel produces Screen 6, showing support for restoring the stopped equipment to a normal operation (S27), as in FIG. 24 (B), Screen 6, showing support for restoring the stopped equipment to a normal operation, displays these messages: "Measures: there is a problem with the cylinder body. Is there any air or oil leak from the cylinder? Investigate the cause by replacing parts or by breaking down the cylinder."

The operator, seeing the messages on the screen, knows that the actuator has malfunctioned and sees that the piping or actuator body is not in order. If it is necessary, the operator replaces the parts.

(16)-b Screen 7 Showing Support for Restoring the Stopped Equipment to a Normal Operation (S31)

If the "No" button is clicked in Screen 3, showing support for restoring the stopped equipment to a normal operation, the touch panel produces Screen 7, showing support for restoring the stopped equipment to normal operation (S31), as in FIG. 24 (C). Screen 7, showing support for restoring the stopped equipment to a normal operation, displays these messages: "There is a problem with a valve. Investigate the cause by replacing the valve or by breaking it down or cleaning it."

The operator, seeing this display on the screen, knows that the valve does not properly function, makes sure if it works, and replaces it if it is necessary.

As explained, the flaskless molding equipment for molding a mold in the present embodiment comprises the combined circuit comprising the pneumatic circuit and the oil hydraulic circuit and adopts the air-on-oil method (the method that uses oil hydraulic pressure converted from air pressure).

More specifically, the flaskless molding equipment for molding a mold 100 comprises:

a plurality of movable members (lower squeezing board 4, lower filling frame 6, upper flask 10, master plate 22, and pushing plate 32) that mold molds (upper mold 54, lower mold 55) from molding sand 51 and pushes them onto the transporting line;

cylinders for a movable member (cylinder for squeezing a set of flasks 2, cylinder for a lower filling frame 5, cylinder for upper flask 9, pattern-shuttle cylinder 21, and cylinder for pushing molds 31) that drive each movable member (lower squeezing board 4, lower filling frame 6, upper flask 10, master plate 22, and pushing plate 32); and the pneumatic circuit 404 or the combined circuit comprising the pneumatic circuit 404 and the oil hydraulic circuit 405.

It further comprises:

mechanisms for driving cylinders (mechanism for driving a cylinder for squeezing a set of flasks 400, etc.) that drive cylinders (cylinder for squeezing a set of flasks 2, cylinder for a lower filling frame 5, cylinder for an upper flask 9, pattern-shuttle cylinder 21, and cylinder for pushing molds 31);

the control circuit (sequencer 200) that controls the electric supply to solenoid valves (SV1, SV2, SV3, SV5, SV6, SV7, SV8, and CV) that are the components of the mechanisms for driving cylinders (mechanism for driving a cylinder for squeezing a set of flasks 400, etc.); and the operation panel (touch panel 300) that has a display and an input switch and that receives a command signal from the control circuit (sequencer 200) and transmits an input signal from the input switch to the control circuit (sequencer 200), wherein the control circuit (sequencer 200) monitors the movements of the movable members (lower squeezing board 4, lower filling frame 6, upper flask 10, master plate 22, and pushing plate 32), the cylinders (cylinder for squeezing a set of flasks 2, cylinder for a lower filling frame 5, cylinder for an upper flask 9, pattern-shuttle cylinder 21, and cylinder for pushing molds 31), and the mechanisms for driving a cylinder (mechanism driving a cylinder for squeezing a set of flasks 400, etc.), and wherein if the period of the operation of each step of the flaskless molding equipment for molding a mold 100 from the start of the operation to the point where the operation of the flaskless molding equipment for molding a mold reaches the predetermined position exceeds the predetermined period that is set to be abnormal, then the control circuit provides support for restoring the stopped equipment to a normal operation, following the instructions displayed on the screen of the operation panel (touch panel 300) and following the operator's input by means of the input switch.

In one embodiment of the present invention, the control circuit (sequencer 200) monitors the movements of the movable members (lower squeezing board 4, lower filling frame 6, upper flask 10, master plate 22, and pushing plate 32), the cylinders (cylinder for squeezing a set of flasks 2, cylinder for a lower filling frame 5, cylinder for upper flask 9, pattern-shuttle cylinder 21, and cylinder for pushing molds 31), and the mechanism for driving a cylinder (mechanism driving a cylinder for squeezing a set of flasks 400, etc.), and wherein if the period of the operation of each step of the flaskless molding equipment for molding a mold from the start of the operation to the point where the operation of the flaskless molding equipment for molding a mold reaches the predetermined position exceeds the predetermined period that is set to be abnormal, then the control circuit provides support for restoring the stopped equipment to a normal operation, following the instructions displayed on the screen of the operation panel (touch panel 300) and following the operator's input by means of the input switch.

So, the equipment that has been stopped can be quickly restored to a normal operation.

Also, after each step of the movements of the cylinder for squeezing a set of flasks 2 is shown on the screen, the operator knows that the cylinder for squeezing a set of flasks 2 is installed in the equipment. Also, by showing the steps of the movements of the cylinder for squeezing a set of flasks 2 on the screen, it is clearly seen whether the cylinder for squeezing a set of flasks 2 is operated.

Also, as the display is arranged to show whether the conditions for the upward movement of the cylinder for squeezing a set of flasks 2 are complied with, one can see whether the cylinder for squeezing a set of flasks can be operational. If they are not complied with, one can determine what obstructs the compliance with the conditions.

As the display is arranged to show a screen showing support for restoring the stopped equipment to a normal operation, one can determine a cause of the stoppage of the equipment. If the cause is simple, and thus its solution is simple, then to determine the cause and to restore the equipment to a normal operation can be quickly carried out, based on the operations by means of the display screen and also by the inspection of the equipment on site. Also, if the stoppage is caused because of any defective part of the cylinder for squeezing a set of flasks 2, or malfunctioning or breakdown of valves of the pneumatic circuit 404 or of the oil hydraulic circuit 405 or failures in the electrical system, one can determine the cause and can quickly restore the equipment that has stopped to a normal operation, by accessing a flow chart that can determine the cause of the stoppage of the equipment.

Further, if the flow chart is shown, even if a person were not experienced in the maintenance of such equipment, the cause of the stoppage of the equipment could still be determined.

As the display is arranged to show the operation of an actuator (cylinder) in the screen showing support for restoring the stopped equipment to a normal operation, one can determine whether the instructions to activate it have been given from the control circuit 200.

As the display is arranged to show in the screen showing support for restoring the stopped equipment to a normal operation a part showing that an electric signal is supplied to a valve connector, one can determine whether the electric signal has reached the valve connector. Depending on the determination, one can see whether the stoppage of the equipment is caused by the malfunctioning of the valve connector, or by any defect in the wiring or electrical parts that are located between the control circuit and the valve connector, or one can see whether the wiring and electrical parts are working normally.

Further, if the instructions to determine the cause are given, even if a person were not experienced in maintenance, nor specialized in that job, that person could still determine whether the cause of the stoppage of the equipment is due to a defective electrical part.

As the display is arranged to show in the screen showing support for restoring the stopped equipment to a normal operation whether there is any article or obstacle that interferes or obstructs the movement of the actuator or the work, one can determine whether the stoppage of the equipment is caused by the interference with the operation of the actuator or the work. Moreover, if the instructions to determine the cause of the stoppage are given, then even if a person were not experienced in maintenance or specialized in the job, that person could still determine whether the stoppage of the equipment is caused by any interference with the actuator or the work.

As the display is arranged to show in the screen showing the support for restoring the stopped equipment to a normal operation, whether air and oil are being supplied from the valves, one can see whether the stoppage is caused by an insufficient supply of fluids to the actuator. Also, if the stoppage was caused by the insufficient supply of the fluids, one can further investigate to see whether the insufficient supply of the fluids was caused by malfunctioning of any valve. If it is caused by the insufficient supply of fluids, one can investigate to see whether the insufficient supply of fluids was caused by leakage of the fluid from piping, etc. If the stoppage was not caused by the insufficient supply of the fluids, one can further investigate to see whether it was caused by trouble with the actuator's main body. Further, if the instructions to determine the cause for the stoppage of the equipment are given, even if a person were not experienced in maintenance nor specialized in the job, that person could still determine whether the stoppage of the equipment is caused by an insufficient supply of air or oil, the malfunctioning of any valve, or trouble with the actuator's main body.

As the display is arranged to show in the screen showing the support for restoring the stopped equipment to a normal operation the measures to restore the equipment to a normal operation the necessary measures, one can find appropriate measures to promptly restore the equipment to a normal operation.

As the screen showing support for restoring the stopped equipment to a normal operation is shown, the person in charge of maintenance looks at the screen as often as any trouble causes the equipment to stop, and determines the causes of the stoppage of the equipment.

So, even if a person were not experienced in the maintenance of the equipment, that person would be trained on site and would become well experienced in maintaining the equipment.

The basic Japanese Patent Application, No. 2010-019142, filed Jan. 29, 2010, is hereby incorporated in its entirety by reference in the present application.

The present invention will become more fully understood from the detailed description of this specification. However, the detailed description and the specific embodiment illustrate desired embodiments of the present invention and are described only for the purpose of explanation. Various possible changes and modifications will be apparent to those of ordinary skill in the art on the basis of the detailed description.

The applicant has no intention to dedicate to the public any disclosed embodiments. Among the disclosed changes and modifications, those that may not literally fall within the scope of the present claims constitute, therefore, a part of the present invention in the sense of the doctrine of equivalents.

The use of the articles "a," "an," and "the," and similar referents in the specification and claims, are to be construed to cover both the singular and the plural, unless otherwise indicated herein or clearly contradicted by the context. The use of any and all examples, or exemplary language (e.g., "such as") provided herein, is intended merely to better illuminate the invention and does not pose a limitation on the scope of the invention unless otherwise claimed.

SYMBOLS

2. cylinder for squeezing a set of flasks (cylinder for a movable member)
4. lower squeezing board
5. cylinder for a lower filling frame (cylinder for a movable member)
6. lower filling frame (movable member)
8. upper squeezing board
9. cylinder for upper flask (cylinder for a movable member)
10. upper flask (movable member)
21. pattern-shuttle cylinder (cylinder for a movable member)
22. master plate (movable member)
23. lower flask
24. match plate
31. cylinder for pushing molds
32. pushing plates (movable member)
51. molding sand
54. upper mold
55. lower mold
100. flaskless molding equipment for molding a mold
200. sequencer (control circuit)
300. touch panel (operation panel)
401. source of compressed air
402. oil tank
403. booster cylinder
404. pneumatic circuit
405. oil hydraulic circuit
500. sensors
V1, V2*a*, V2*b*, valves (pneumatic circuit)
CV cutoff valve (solenoid valve, oil hydraulic circuit)
SV1, SV2, SV3, SV5, SV6, SV7, and SV8, solenoid valves (pneumatic circuit)
PS pressure switch (sensor)

The invention claimed is:

1. A method for controlling the operation of a process for molding a mold in flaskless molding equipment, the flaskless molding equipment having a plurality of movable members that carry out work starting from molding molds from molding sand to pushing the molds onto a transporting line; cylinders for each movable member that move each movable member; a mechanism for driving a cylinder that drives each cylinder, the mechanism for driving a cylinder having a pneumatic circuit, or a combined circuit including a pneumatic circuit and an oil hydraulic circuit; a control circuit that controls an electrical current to a solenoid valve that constitutes the mechanism for driving a cylinder; and an operation panel that has a screen and an input switch and that receives a command signal from the control circuit and sends an input signal received from the input switch to the control circuit; the method comprising:

monitoring movements of the movable members, the cylinders, and the mechanisms for driving a cylinder with the control circuit during operation of each step of the molding process of the flaskless molding equipment for molding a mold from a start of the operation;

determining an operating time of the molding process from the start of the operation to the arrival of the molding process at a predetermined position exceeds a predetermined value of operating time that is set to be abnormal and stopping the molding process; and restoring the stopped process to a normal operation with support from the control circuit, following instructions displayed on the screen of the operation panel and following an operator's input by means of the input switch.

2. The method for controlling the operation of a process for molding a mold in the flaskless molding equipment of claim 1, wherein the cylinders include a cylinder for squeezing a set of flasks and the mechanism for driving the cylinder for squeezing the set of flasks, the mechanism for driving the cylinder for squeezing the set of flasks having the combined circuit including the pneumatic circuit and the oil hydraulic circuit and the method includes displaying the steps of the operation of the cylinder for squeezing a set of flasks on the screen of the operation panel.

3. The method for controlling the operation of a process for molding a mold in the flaskless molding equipment of claim 2, wherein the display shows whether conditions for upward movement of the cylinder for squeezing a set of flasks are complied with.

4. The method for controlling the operation of a process for molding a mold in the flaskless molding equipment of claim 3, wherein the display shows a screen showing support for restoring the stopped process to the normal operation.

5. The method for controlling the operation of a process for molding a mold in the flaskless molding equipment of claim 4, wherein the display shows the operation of an actuator in the screen showing support for restoring the stopped process to the normal operation.

6. The method for controlling the operation of a process for molding a mold in the flaskless molding equipment of claim 4, wherein the display shows in the screen showing support for restoring the stopped process to the normal operation, a part showing that an electric signal is being supplied to a valve connector.

7. The method for controlling the operation of a process for molding a mold in the flaskless molding equipment of claim 4, wherein the display shows in the screen showing support for restoring the stopped process to the normal operation, whether there is any article or obstacle that interferes or obstructs the movement of the actuator or work.

8. The method for controlling the operation of a process for molding a mold in the flaskless molding equipment of claim 4, wherein the display shows in the screen showing support for restoring the stopped process to the normal operation, whether air and oil are being supplied by valves.

9. The method for controlling the operation of a process for molding a mold in the flaskless molding equipment of any one of claims 6 to 8, wherein the display shows in the screen showing support for restoring the stopped process to the normal operation, necessary measures for restoring the stopped process to a normal operation.

10. The method for controlling the operation of a process for molding a mold in the flaskless molding equipment of claim 2, wherein the cylinders are a pattern-shuttle cylinder.

11. The method for controlling the operation of a process for molding a mold in the flaskless molding equipment of claim 10, wherein the cylinders include a cylinder for a lower filling frame.

12. The method for controlling the operation of a process for molding a mold in the flaskless molding equipment of claim 11, wherein the cylinders include a cylinder for an upper flask.

13. The method for controlling the operation of a process for molding a mold in the flaskless molding equipment of claim 12, wherein the cylinders include a cylinder for pushing molds.

* * * * *